US010792730B2

(12) United States Patent
Strolego et al.

(10) Patent No.: US 10,792,730 B2
(45) Date of Patent: Oct. 6, 2020

(54) PRODUCTION PLANT OF METAL RODS, CASTING MACHINE, CASTING PROCESS AND CONTROL METHOD OF ELECTROMAGNETIC STIRRER DEVICES OF MOLTEN METAL

(71) Applicant: ERGOLINES LAB S.R.L., Trieste (IT)

(72) Inventors: Sabrina Strolego, Trieste (IT); Stefano De Monte, Trieste (IT); Stefano Spagnul, Trieste (IT); Cristiano Persi, Trieste (IT)

(73) Assignee: ERGOLINES LAB S.R.L., Trieste (IT)

( * ) Notice: Subject to any disclaimer, the term of this patent is extended or adjusted under 35 U.S.C. 154(b) by 32 days.

(21) Appl. No.: 16/064,802

(22) PCT Filed: Dec. 20, 2016

(86) PCT No.: PCT/EP2016/002127

§ 371 (c)(1),
(2) Date: Jun. 21, 2018

(87) PCT Pub. No.: WO2017/114587

PCT Pub. Date: Jul. 6, 2017

(65) Prior Publication Data

US 2018/0369903 A1 Dec. 27, 2018

(30) Foreign Application Priority Data

Dec. 30, 2015 (IT) ..... 102015000089005

(51) Int. Cl.
*B22D 11/115* (2006.01)
*B22D 11/14* (2006.01)
*B22D 11/16* (2006.01)

(52) U.S. Cl.
CPC ..... *B22D 11/115* (2013.01); *B22D 11/141* (2013.01); *B22D 11/16* (2013.01)

(58) Field of Classification Search
CPC ... B22D 11/114; B22D 11/115; B22D 11/141; B22D 11/16; B22D 11/20; B22D 11/205
See application file for complete search history.

(56) References Cited

U.S. PATENT DOCUMENTS 4,957,156 A * 9/1990 Mayrhofer ..... B22D 11/115 164/468
5,279,351 A 1/1994 Metz
(Continued)

FOREIGN PATENT DOCUMENTS

CN 103182495 B 4/2015
EP 0080326 A1 6/1983
(Continued)

OTHER PUBLICATIONS

International Search Report for corresponding PCT/EP2016/002127.

*Primary Examiner* — Kevin P Kerns
*Assistant Examiner* — Steven S Ha
(74) *Attorney, Agent, or Firm* — Egbert Law Offices, PLLC

(57) ABSTRACT

Production plant of metal rods, casting machine, casting process and control method of at least three electromagnetic stirrer devices, wherein one provides at least one phase of switching between two operating configurations of the electromagnetic stirrer devices of which a first operating configuration with the generation of a rotating electromagnetic field inducing in the metallic material in the molten state a rotational motion and a second operating configuration with the generation of a linear electromagnetic field inducing in the metallic material in the molten state a linear motion.

14 Claims, 9 Drawing Sheets

(56) References Cited

U.S. PATENT DOCUMENTS

| | | | | |
|---|---|---|---|---|
| 2008/0164004 | A1 | 7/2008 | Kolesnichenko | |
| 2015/0151355 | A1 * | 6/2015 | De Monte | B22D 11/115 164/451 |

FOREIGN PATENT DOCUMENTS

| | | | | | |
|---|---|---|---|---|---|
| JP | 60068146 | A | * | 4/1985 | B22D 11/115 |
| WO | 2013174512 | A2 | | 11/2013 | |
| WO | 2015079071 | A2 | | 6/2015 | |

* cited by examiner

PRODUCTION PLANT OF METAL RODS, CASTING MACHINE, CASTING PROCESS AND CONTROL METHOD OF ELECTROMAGNETIC STIRRER DEVICES OF MOLTEN METAL

TECHNICAL FIELD

The present invention relates to a control method of electromagnetic stirrer devices of metallic material in the molten state in a casting machine according to the characteristics of the pre-characterizing part of claim 1.

The present invention also relates to a casting machine according to the characteristics of the pre-characterizing part of claim 8.

The present invention also relates to a production plant of metallic material rods according to the characteristics of the pre-characterizing part of claim 12.

The present invention also relates to a casting process for the production of metallic material rods according to the characteristics of the pre-characterizing part of claim 13.

Definitions

In the present description and in the appended claims the following terms must be understood according to the definitions given in the following.

By the expression "metal rod" one means all kinds of products of a casting machine, such as billets, blooms or slabs with different shapes in section such as with a square, rectangular, round, polygonal section.

By the expression "casting machine" one means both vertical casting machines and bending-type casting machines.

Prior Art

In the field of the production of steel or, in general, of metals and metal alloys, an essential role is played by continuous casting machines. Casting is a production process which allows to produce steelwork semi-finished products called billets, blooms, slabs depending on their size and shape. The production of the semi-finished products occurs starting from the metal or metal alloy in the molten state which is cast in a mould cooled by means of a cooling fluid which flows according to a direction in counter-current with respect to the direction of advancement of the metallic semi-finished product which is progressively formed within the volume of the mould. The mould is placed according to an essentially vertical arrangement. The mould is open at its lower end from which the semi-finished product being formed comes out. The mould is open at its upper end from which the liquid metal enters, which progressively begins to solidify within the mould to be then extracted from the lower end of the mould. The process is stationary, meaning that in the unit of time an amount of metal at least partially solidified comes out from the lower part of the mould, which corresponds to the amount of liquid metal which enters the mould on its upper part. Once the casting process has been started, the level of the liquid metal within the mould is kept essentially constant, that is to say, the position of the free surface of the liquid metal, that is to say, the position of the so-called meniscus, with respect to the internal wall of the mould is kept essentially constant in time during the process. In order to keep the level of the liquid metal constant, that is to say, to keep the position of the meniscus constant, it is possible to act by varying the speed of extraction of the material being formed in the mould or it is possible to act by varying the flow of liquid metal which enters the mould from its upper end. This occurs on the basis of the detection of the position of the meniscus in the mould.

In the field of the production of continuous casting plants of metallic materials, in general steels and metal alloys, it is also known to resort to electromagnetic stirring devices of the metallic material in the molten state, generally known as stirrers. The stirrer produces an electromagnetic field generating a force inside the die or mould within which the metallic material in the molten state is inducing a movement flow inside the molten bath obtaining a stirring effect of the latter. In the die or mould the cooling of the surface or skin of the metal rod which is generated in the die occurs and, in correspondence of the exit of the metal rod from the die or mould, it has a solidified perimeter zone or shell having a thickness of 10-30 mm inside which there is a core in which the metallic material is still in the molten state and which is progressively solidified upon advancement of the metal rod within a cooling chamber of the casting machine in which it is subjected to the action of cooling units, which generally consist of a series of water sprayers. Applications of the stirrers are known both in correspondence of the die or mould within which the introduction of the metallic material in the molten state occurs and applications of the stirrers in correspondence of the cooling chamber of the casting machine to obtain improvements in the quality of the structure of the metal rod and reduce the occurrence of defects.

The stirrer consists of a casing inside which electrical windings are arranged for the passage of a current which induces an electromagnetic stirring field. The casing has an open duct within which the hot rod passes. For example the use of stirrers contributes to reducing superficial and under-skin blowholes and inclusions, cracks, porosity, segregation and contributes to improving the solidification structures.

Two essential types of stirrers are known, which are the stirrers of the rotary type and the stirrers of the linear type. In the case of the stirrers of the rotary type, the stirrer produces an electromagnetic field generating a force inside the die or mould within which the metallic material in the molten state is inducing a rotating flow inside the molten bath in which the rotating flow occurs on a plane which is essentially orthogonal to the direction of extraction of the metal rod being formed in the mould, obtaining the stirring effect of the molten bath itself. In the case of the stirrers of the linear type, the stirrer produces an electromagnetic field generating a force inside the die or mould within which the metallic material in the molten state is inducing a flow inside the molten bath in which the flow is oriented according to a direction which is essentially parallel with respect to the direction of extraction of the metal rod being formed in the mould, obtaining the stirring effect of the molten bath itself.

Continuous casting machines and semi-continuous casting machines are known, such as those described in WO 2015 079071 which describes a method for the semi-continuous casting of a strand of steel, in which a controlled cooling of the semi-solidified strand is provided after its extraction from the mould until complete solidification of the strand, the cooling occurring in a tertiary cooling zone of the casting machine.

Solutions of stirrers which are mobile along different positions in the casting chamber of a casting machine are known, such as the solution described in WO 2013/174512 in the name of the same applicant, to be considered as incorporated for reference.

Patent application CN 103 182 495 describes a multifunctional electromagnetic stirrer, comprising six layers of annular cores which are horizontally arranged, six rack cores which are vertically arranged and thirty-six identical solenoid coil windings. The six layers of annular cores are mutually independent layer by layer. The six layers of annular cores are aligned vertically and are separated at intervals. The inner wall of each layer of annular core is provided with six salient poles. The six rack cores are uniformly distributed on the outer walls of the annular cores; each rack core is provided with five salient poles. The salient poles of the rack cores are inserted into the intervals, which are vertically separated, of the annular poles. The salient poles of each rack core and the salient poles of the six layers of annular cores are located on the same circumference. The top surfaces of the salient poles of each rack core are inserted into the inner walls between the salient poles of the annular cores. The thirty-six solenoid coil windings are respectively sleeved on each salient pole of the annular cores. A three-phase low-frequency alternating current is supplied by a variable-frequency power source. According to the disclosed solution the described structure can be used as a structural base for configuring different modes of connection of the coils installed in correspondence of the different poles in such a way that the base structure can be made independently of the following configuration of connection of the coils and, therefore, subsequently personalized and configured in a fixed way according to the desired connection diagram of the coils.

Patent application EP 0 080 326 describes a casting machine comprising a mould and electromagnetic stirring means located about the metal strand path. The electromagnetic stirring means comprise a set of electromagnetic coils disposed about the strand. The set of coils is connected to two separate power sources by means of two separate sets of connections such that one power supply and set of connections activates the set of coils to provide a rotational field force upon the strand, and the other power supply and set of connections activates the set of coils to provide an axial field force upon the strand.

Problems of the Prior Art

The prior art solutions are generally limited to the alternative application of one type of stirrers or of the other, that is to say, there exist casting machines provided with rotary stirrers and casting machines provided with linear stirrers.

The combination of the two operating modes is not contemplated due to the incompatibility of the devices used in the two configurations. That is to say, if a casting machine is configured with inverters and stirrers, which are suitable for operation as rotary stirrers, it is unsuitable for operation as a casting machine with linear stirrers. Vice versa, if a casting machine is configured with inverters and stirrers suitable for operation as linear stirrers, it is unsuitable for operation as a casting machine with rotary stirrers.

Aim of the Invention

The aim of the present invention is to provide a stirrer and a control method of the stirrer which allows for a configurability between an operating condition in which the stirrer acts as a rotary stirrer and an operating condition in which the stirrer acts as a linear stirrer.

Concept of the Invention

The aim is achieved by the characteristics of the main claim. The sub-claims represent advantageous solutions.

Advantageous Effects of the Invention

The solution according to the present invention, by the considerable creative contribution the effect of which constitutes an immediate and important technical progress, presents various advantages.

The configurability of the stirrer between the operating modes as a rotary stirrer and a linear stirrer on a same casting machine allows to be able to operate with a same casting machine according to different operating modes which are respectively suitable for the casting of different types of cast product with different qualities, which, according to the available prior art solutions, would require, on the other hand, the use of two different casting machines. Advantageously, the described solution allows to realize casting machines which are easily configurable between different operating conditions, such as a first operating configuration in which one single product is cast in the casting machine, which may be subjected to a stirring action of the molten bath by means of a rotary or linear stirrer or a combination thereof with alternate phases of rotary stirring and of linear stirring, and a second operating configuration in which two products are simultaneously cast in the casting machine on parallel casting lines of the same machine, wherein each of the two cast products is subjected to a stirring action of the molten bath by means of stirrers exploiting the same devices used to obtain the stirring of the molten bath in the first operating configuration. Particularly in the first operating configuration, the solution according to the present invention thus allows to be able to benefit from both methods of rotary stirrer and linear stirrer combining their benefits and consequently improving the final results. Particularly in the second operating configuration, the solution according to the present invention also allows to be able to use the same casting machine according to operating modes with a high productivity of metal rods, enabling the production of multiple metal rods on the same casting machine.

DESCRIPTION OF THE DRAWINGS

In the following a solution is described with reference to the enclosed drawings, which are to be considered as a non-exhaustive example of the present invention in which.

DESCRIPTION OF THE INVENTION

With reference to the figures (FIG. 1, FIG. 9, FIG. 10, FIG. 11, FIG. 12) the present invention relates to an electromagnetic stirrer device (1, 1', 1", 1''', 1'''') of metallic material in the molten state of the type usually called "stirrer". The electromagnetic stirrer device (1) according to the present invention is intended to be applied in a casting machine (18). The system according to the invention is suitable for the application both on casting machines (18) of the continuous type and on casting machines of the semi-continuous type. An example of casting machines of the semi-continuous type is given by the solution described in WO 2015 079071, which is to be considered as incorporated for reference, which describes a method for the semi-continuous casting of a strand of steel, in which a controlled cooling of the semi-solidified strand is provided after its extraction from the mould until complete solidification of the strand, the cooling occurring in a tertiary cooling zone of the casting machine.

Figure 13:
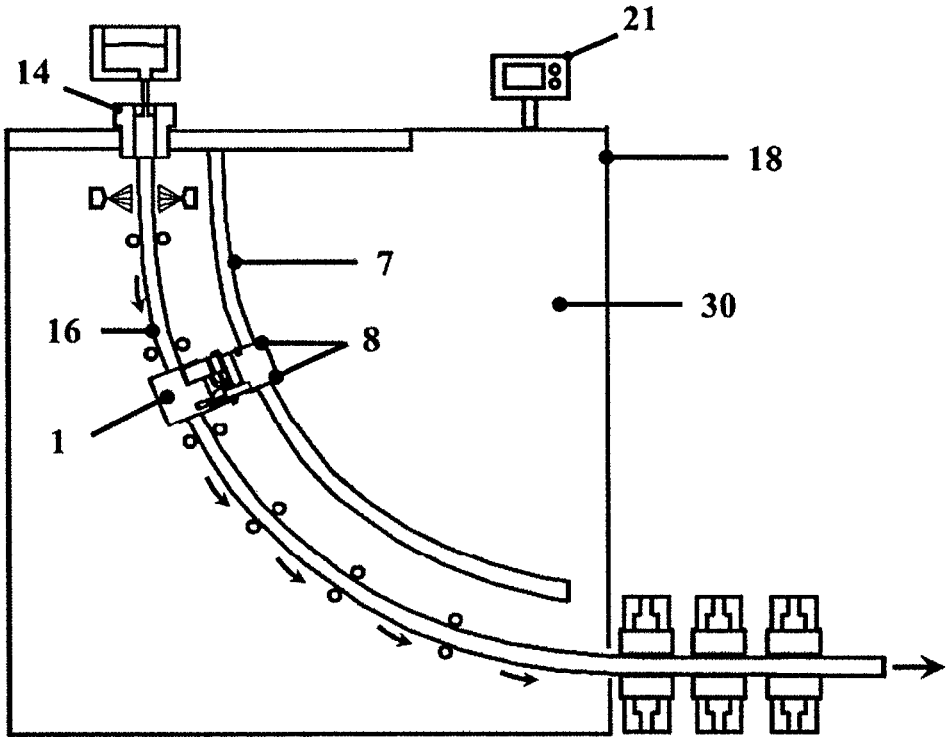
FIG. 13 and FIG. 14 schematically show an application of the present invention with a mobile stirrer in a bending-type casting machine.
Figure 14:
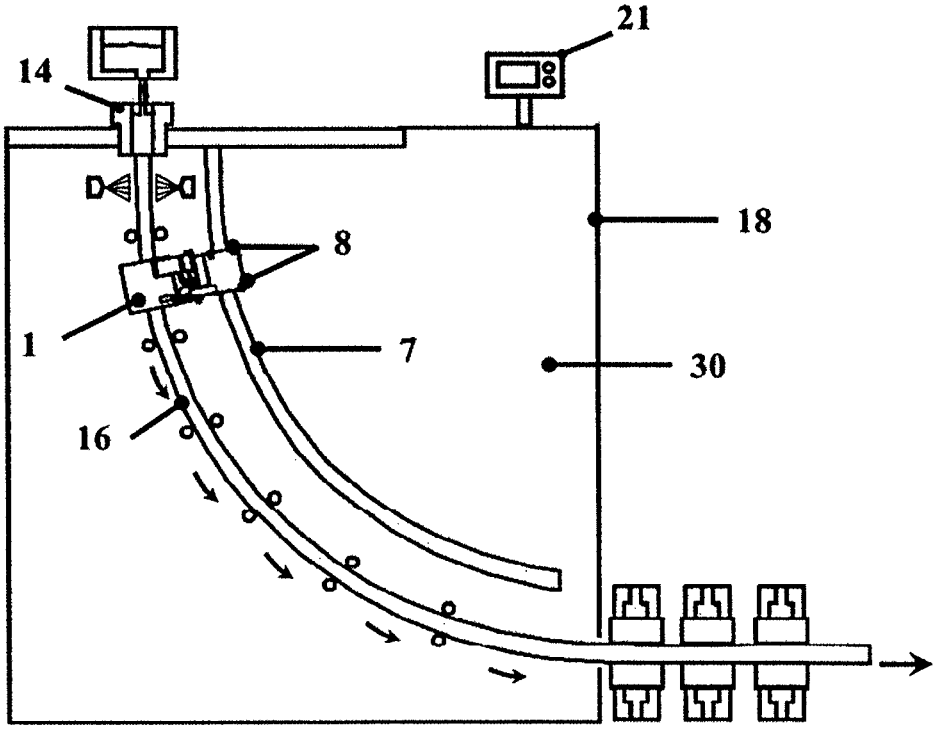
Figure 15:
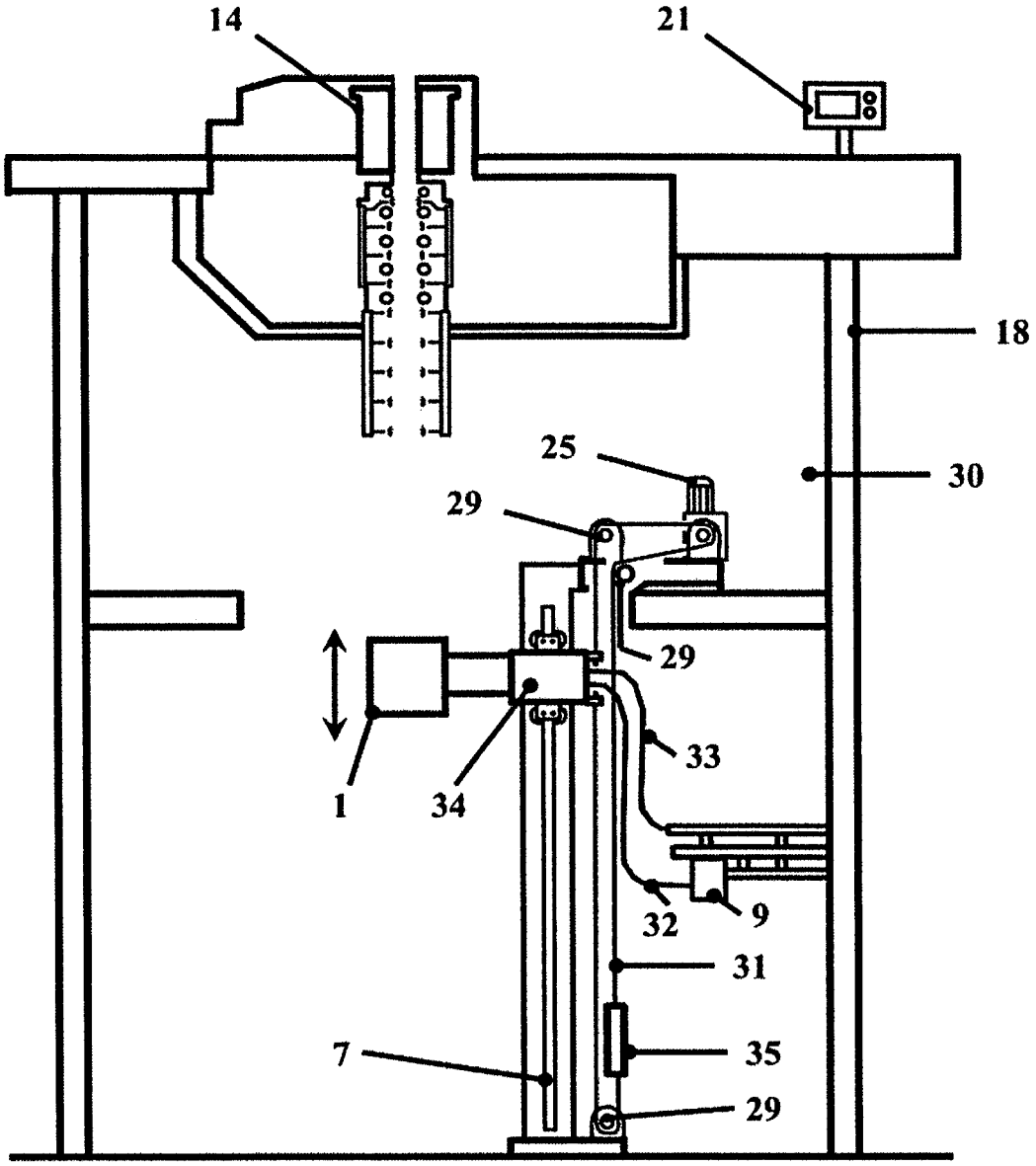
FIG. 15 schematically shows an application of the present invention with a mobile stirrer in a vertical casting machine.

In general the solution according to the invention is suitable both for casting machines of the vertical type (FIG. 15) and for bending-type casting machines (FIG. 13, FIG. 14). In general (FIG. 1) in the casting machine (18) the metallic material in the molten state is cast from a tundish (19) into a mould (14) placed below the tundish (19) and in which the metallic material rod (16) comes out of the mould on its lower part according to a direction of extraction (22). The metallic material rod (16) may be, by way of example and without limitation for the purposes of the present invention, a billet, a bloom or a slab with different shapes in section, such as with a square, rectangular, round, polygonal section. In the present description and in the appended claims by the expression "casting machine" one thus means vertical casting machines, bending-type casting machines, continuous casting machines, semi-continuous casting machines. The electromagnetic stirrer device (1, 1', 1", 1''', 1'''') exerts a stirring force by means of the application of a current of generation of an electromagnetic field through windings or induction coils (20', 20", 20'''). The stirring force acts in correspondence of the partially solidified metallic material rod (16) being formed within the mould (14) but one may also provide embodiments in which the stirring action is induced on the partially solidified metallic material rod (16) after it has already come out of the mould (14). In fact, when the metallic material rod (16) comes out of the mould (14) it is not in a condition of complete solidification yet but the metallic material rod (16) consists of a shell in the solid state enclosing a core in the molten state. In this case, the electromagnetic stirring device (1, 1', 1", 1''', 1'''') acts and exerts its own action by means of the electromagnetic stirring field on the core in the molten state of the partially solidified metallic material rod (16). In the case of the application in the mould the field acts on the metallic material in the molten state, which is kept at a constant level balancing the amount of material introduced into the mould and material extracted from the mould in such a way that the meniscus (15) is approximately always in the same position inside the mould.

The electromagnetic stirrer device (1, 1', 1", 1''', 1'''', 11*a*, 11 *b*) is driven (FIG. 2, FIG. 3, FIG. 4, FIG. 7, FIG. 8) by means of inverters (2, 2', 2", 2''', 2''''). The inverters are devices suitable to convert a mains three-phase alternating voltage, having fixed voltage and frequency, provided at a power supply input (3), into a driving alternating voltage of variable amplitude and having a frequency which is set on the basis of a reference signal provided at a reference input (4) of the inverter (2, 2', 2", 2''', 2"). The inverters are devices which are further suitable to convert a voltage provided at a power supply input (3) as input direct current into a driving alternating voltage of variable amplitude and having a frequency which is set on the basis of a reference signal provided at a reference input (4) of the inverter (2, 2', 2", 2''', 2''''). According to the inverter model it is possible to connect at the output a load to be driven which can be a balanced load with 2 or 3 phases or an unbalanced load with 3 phases, as in the case of a stirrer or electromagnetic stirrer device (1,1', 1", 1''', 1'''', 11*a*, 11*b*).

In general, when (FIG. 2) one has to supply a balanced three-phase load, as a stirrer device of the rotary type (11*a*), it is necessary to use an inverter (2), provided with three output IGBT branches, that is to say, a first IGBT branch related to the first phase, a second IGBT branch related to the second phase, a third IGBT branch related to the third phase. In general, when (FIG. 3, FIG. 4, FIG. 7) one has to supply an unbalanced three-phase load, as a stirrer device of the linear type (11*b*), it is necessary to use an inverter (2) provided with three output IGBT branches, that is to say, a first IGBT branch related to the first phase, a second IGBT branch related to the second phase, a third IGBT branch related to the third phase and further provided with a fourth output IGBT branch. In this case the fourth phase related to the fourth output IGBT branch must be connected to the neutral conductor of the load (star point).

By modifying the current and the frequency applied to the stirrer or electromagnetic stirrer device (1, 1', 1", 1''', 1'''', 11*a*, 11*b*) by means of the inverter (2) an electromagnetic field is generated, which acts with different stirring force and speed on the metallic material in the molten state of the rod (16) being formed. In this way it is possible to apply this force to the metallic material in the molten state during the casting phase. The force applied to the metallic material in the molten state by the stirrer or electromagnetic stirrer device will provide greater quality to the rod once the final product has been obtained.

The control device (5), which is in the control stage (6) inside the inverter (2, 2', 2", 2''', 2''''), can work normally with a current feedback signal, which is obtained by means (FIG. 7) of a current sensor (27), for example inside the inverter. The current feedback signal may be compared with a corresponding current reference I-reference which can range between an I-minimum value=0 and an I-nominal value which defines the nominal working current for the inverter (2, 2', 2", 2''', 2''''). From the comparison between the current feedback signal and the corresponding current reference a current error signal is obtained, which is sent to a current regulator which increases or decreases the output voltage of the inverter (2, 2', 2", 2''', 2'''') in such a way as to obtain an output current equal to the corresponding current reference I-reference. The control device (5) uses a vector control which is able to provide high precision in the adjustment of the current supplied by the inverter (2, 2', 2", 2''', 2'''') with great stability.

The working parameters of the inverter can be modified by an operator panel or computer with a dedicated program. The inverter can work according to different modes, such as a service mode in which commands and references are set through the operator panel, a control mode by means of digital and analogue inputs in which commands and references are set through such inputs, a control mode by means of a serial communication line controllable by a programmable control device.

In general, the inverter can provide at the output a three-phase voltage in which each phase can have a frequency variable between a minimum driving frequency Fmin and a maximum driving frequency Fmax. The inverter (2, 2', 2", 2''', 2'''') can be configured and structured to provide at the output a driving current ranging between an I-minimum value=0 and an I-nominal value which can be selected depending on the characteristics of the stirrer or electromagnetic stirrer device. By way of example and without limitation for the purposes of the present invention the currents of generation of the electromagnetic field can be alternating currents having a frequency between 1 and 50 Hertz and intensity between 100 and 1000 amperes. In general, the inverter comprises different commands. For example the inverter comprises a pre-charge activation command following which the control device (5) closes a pre-charge contactor until reaching a voltage of the DC bus which is at least equal to a pre-charge value, in general about 80% of the final value. When the pre-charge value has been reached, the control device (5) closes a main contactor and the pre-charge phase ends.

In this case the inverter goes into a state corresponding to a ready-to-start condition. The inverter further comprises a start command, which can be sent when the inverter is in the ready-to-start state. When the start command is given, the inverter goes into the started condition and begins the modulation of the output voltage, providing it with the required value to obtain the required output voltage through the space-vector modulator. In this way it is possible to obtain an output voltage from the inverter equal to 96% of the input voltage. The inverter comprises a stop command following which the inverter performs a descending voltage ramp at the end of which it disables the power applied to the stirrer, returning to the state corresponding to a ready-to-start condition. The inverter comprises a pre-charge deactivation command following which the control device (5) of the control stage (6) of the inverter opens the main contactor. In this case the inverter goes into a non-ready-to-start state. The inverter comprises a start command of an alternate cycle operating mode. In this alternate cycle operating mode, the supplied current is not always equal to the desired current reference, but the supplied current passes from a positive cycle in which the electromagnetic field rotates in a first direction of rotation, for example clockwise, for a given specifiable first period to a negative cycle in which the electromagnetic field rotates in a second direction of direction opposite to the first direction, for example counter-clockwise, for a given specifiable second period.

The control device (5) of the control stage (6) of the inverter also performs a monitoring of the unbalance of the supplied currents relative to the different phases. If the measured current differs from the set one by a value higher than a given alarm threshold, for example thirty amperes, for a time longer than a given alarm time interval, for example fifteen seconds, an alarm signal is generated. If the measured current differs from the set one by a value higher than a given breakdown threshold, for example fifty amperes, for a time longer than a given breakdown time interval, for example twenty seconds, a breakdown signal is generated. By means of said monitoring system it is possible to control whether the stirrer or its connection cables are in critical conditions, such as malfunctions or breakdowns.

In general the inverter comprises a control stage (6) and a power stage (26) which in its turn comprises an AC/DC converter for conversion from AC voltage to DC voltage and a DC/AC converter for conversion from DC voltage to AC voltage. Such parts are assembled in one single apparatus in such a way that the inverter can be considered as an AC/AC converter. For example (FIG. 2) a three-phase inverter (2) suitable for the driving of a stirrer of the rotary type (11*a*) can comprise the control stage (6) and the power stage (26) which is configured and structured to drive a first coil (20'), a second coil (20") and a third coil (20''') of the electromagnetic stirrer device of the rotary type (11*a*). For example (FIG. 3) a three-phase inverter (2) suitable for the driving of a stirrer of the linear type (11*b*) can comprise the control stage (6) and the power stage (26) which is configured and structured to drive a first coil (20'), a second coil (20") and a third coil (20''') of the electromagnetic stirrer device of the linear type (11*b*). In this case the inverter (2) is provided with a fourth branch connected to the unbalanced three-phase load consisting of the electromagnetic stirrer device of the linear type (11*b*).

As explained, the stirrers or electromagnetic stirrer devices commonly used in the practice are rotary electromagnetic stirrer devices (11*a*) and linear electromagnetic stirrer devices (11*b*). With particular reference to a linear electromagnetic stirrer device (11*b*), it uses an electromagnetic field that is varied linearly along a longitudinal development axis of the linear electromagnetic stirrer device (11*b*). With particular reference to a rotary electromagnetic stirrer device (11*a*), it uses an electromagnetic field rotating around a longitudinal development axis of the rotary electromagnetic stirrer device (11*a*). Both the rotary electromagnetic stirrer device (11*a*) and the linear electromagnetic stirrer device (11*b*) perform an action of mixing of the molten metal of the partially solidified metallic material rod (16) being produced.

In the linear electromagnetic stirrer device (1, 1', 1", 1''', 1'''', 11*b*) the coils (20', 20", 20") are arranged (FIG. 9, FIG. 10, FIG. 11, FIG. 12) in line one after the other along a longitudinal development axis (23) of the linear electromagnetic stirrer device (1, 1', 1", 1''', 1'''', 11*b*). For example one can provide solutions of a linear electromagnetic stirrer device (1, 1', 1", 1''', 1'''', 11*b*) provided with a first coil (20'), a second coil (20"), a third coil (20"). When these coils (20', 20", 20") are supplied by a three-phase current the result which is obtained is a moving electromagnetic field. The electromagnetic field that varies in time induces induced currents in the molten metal of the partially solidified metallic material rod (16) being produced. Said induced currents react with the electromagnetic field giving rise to forces which set in motion the molten metal of the partially solidified metallic material rod (16) being produced, generating a flow of molten metal. A strong flow of molten metal generates strong shear stresses and the shear forces break the dendritic formations near the solid-liquid interface of the partially solidified metallic material rod (16) being produced.

In a rotary stirrer or electromagnetic stirrer device (11*a*) there are generally six coils which are arranged in space at 60° angles with respect to each other around the mould. The opposite coils are reciprocally connected in anti-series in such a way as to generate a field which generates a force acting in the same direction. The resulting electrical phase shift relative to the three command phases of the coils is, therefore, of 120° in such a way that the rotary electromagnetic stirrer device (11*a*) is excited by a three-phase current with a phase shift of 120°. The load is thus balanced.

In a linear stirrer or electromagnetic stirrer device (11*b*), on the other hand, the windings of the coils (20', 20", 20'") are arranged (FIG. 9) on one single plane (24) according to a configuration in which the coils (20', 20", 20'") are placed in line one after the other along a longitudinal development axis (23) of the electromagnetic stirrer device. The supply is carried out with a three-phase current phase-shifted by 120°. Due to the non-symmetry of the linear stirrer or electromagnetic stirrer device (11*b*) the load is unbalanced. With a classic three-phase inverter it is not possible to manage an unbalanced load without introducing an unbalance in the currents as well. To obtain a sinusoidal three-phase current with the same amplitude phase-shifted by 120° it is necessary to use a special 3-phase inverter provided with a fourth branch and the connection occurs in such a way that the fourth phase related to the fourth output branch is connected to the neutral conductor of the load, that is to say, to the star point of connection of the coils (20', 20", 20'"). The main characteristic of a three-phase inverter with the additional branch for neutral is to be able to manage unbalanced loads.

Figure 1:
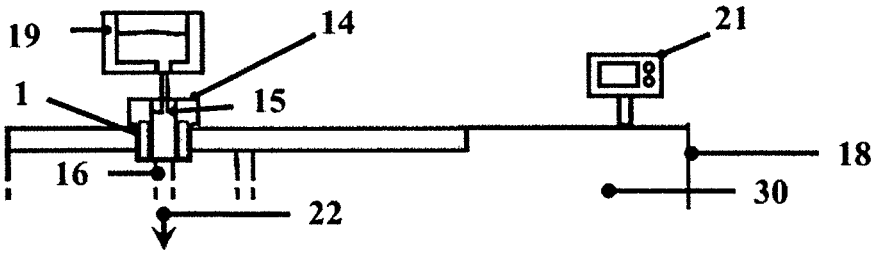
FIG. 1 shows a casting machine incorporating the system according to the invention.
Figure 2:
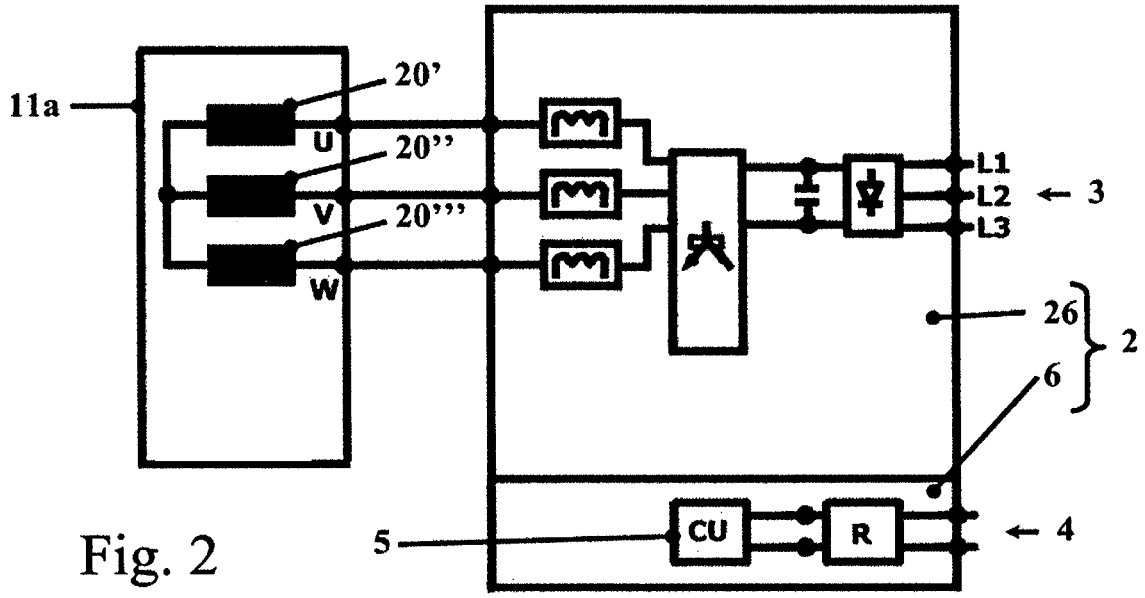
FIG. 2 shows a three-phase inverter for the driving of a stirrer.
Figure 3:
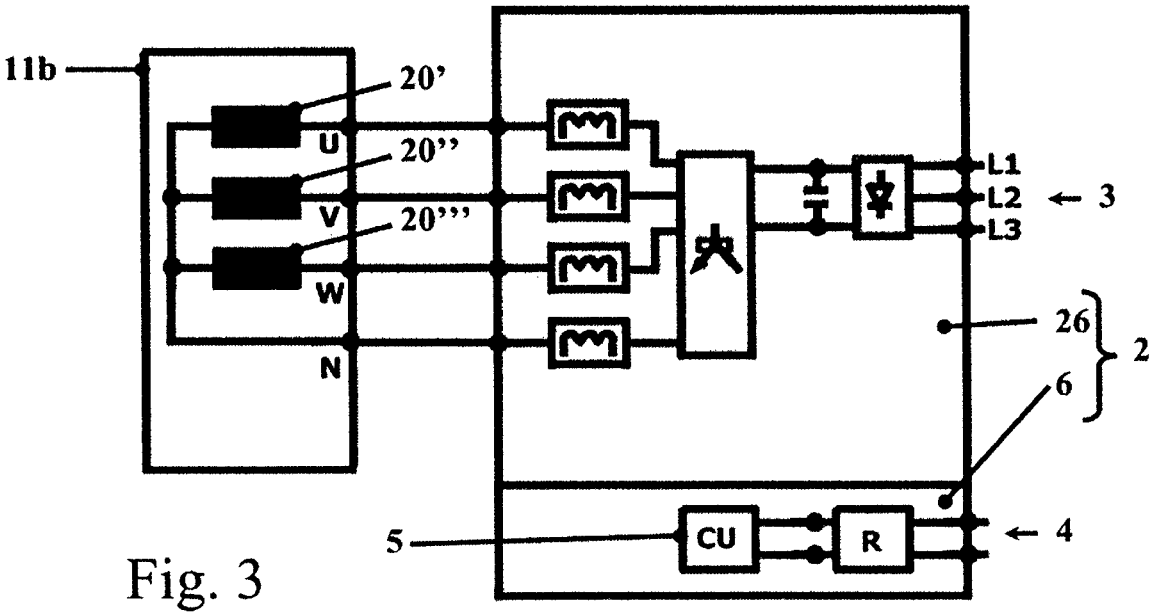
FIG. 3 shows a three-phase inverter suitable for the driving of a linear stirrer.
Figure 4:
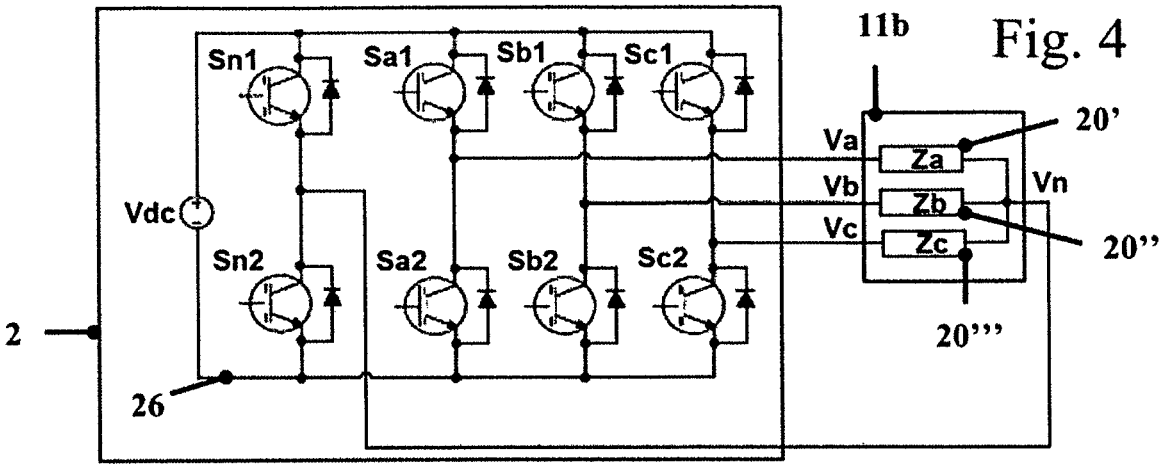
FIG. 4 shows the power stage of a three-phase inverter for the driving of a linear stirrer.
Figure 5:
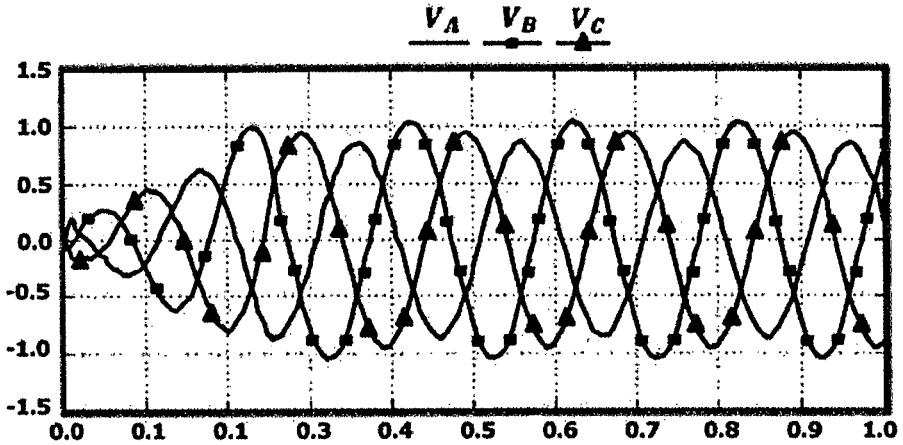
FIG. 5 and FIG. 6 schematically show the trends of the voltage and current waveforms in the case of a connection configuration as in FIG. 4.
Figure 6:
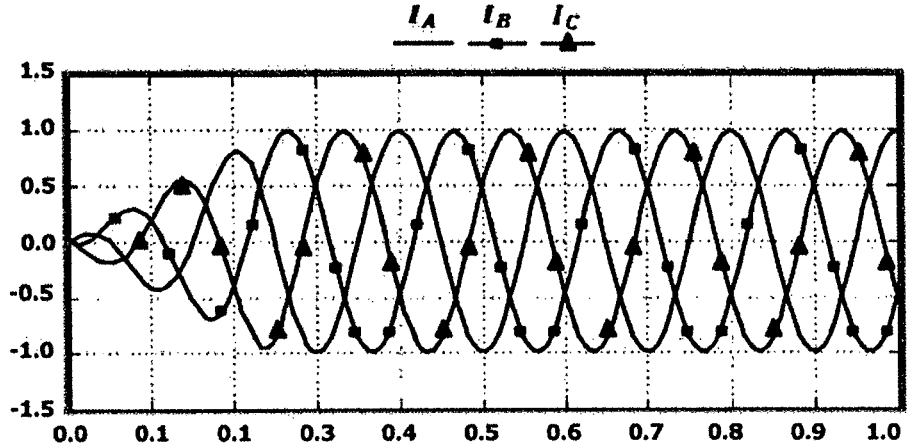
Figure 7:
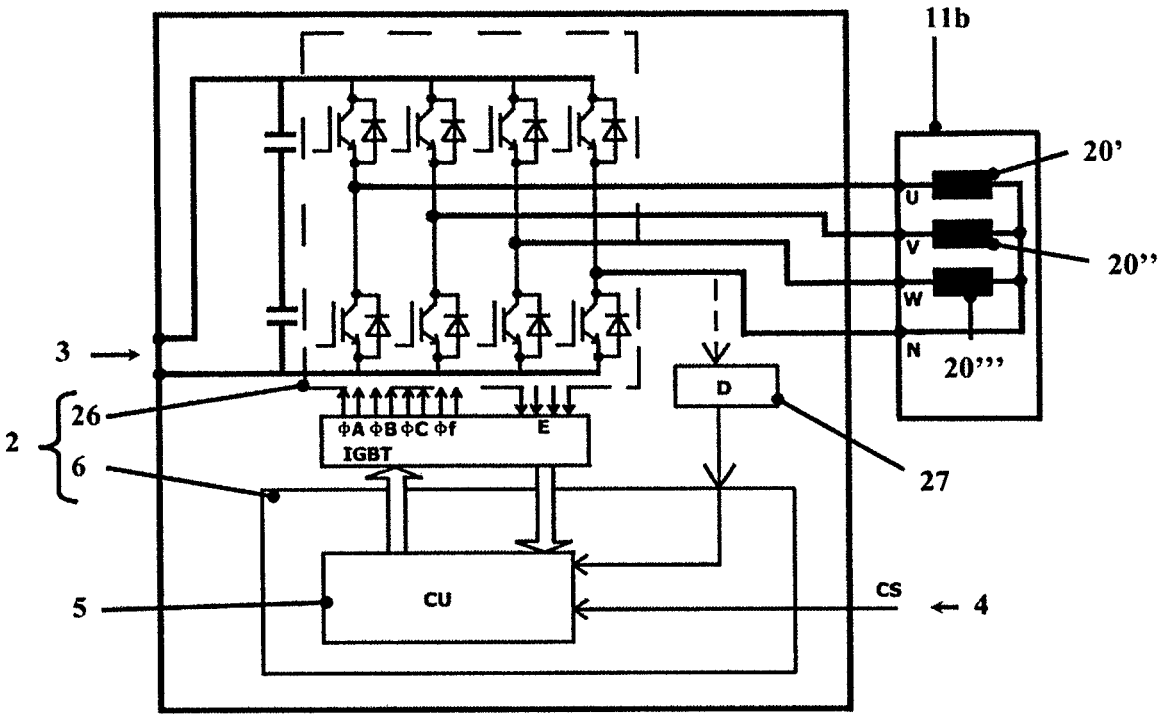
FIG. 7 shows a diagram of an inverter suitable for the driving of a linear stirrer.
Figure 8:
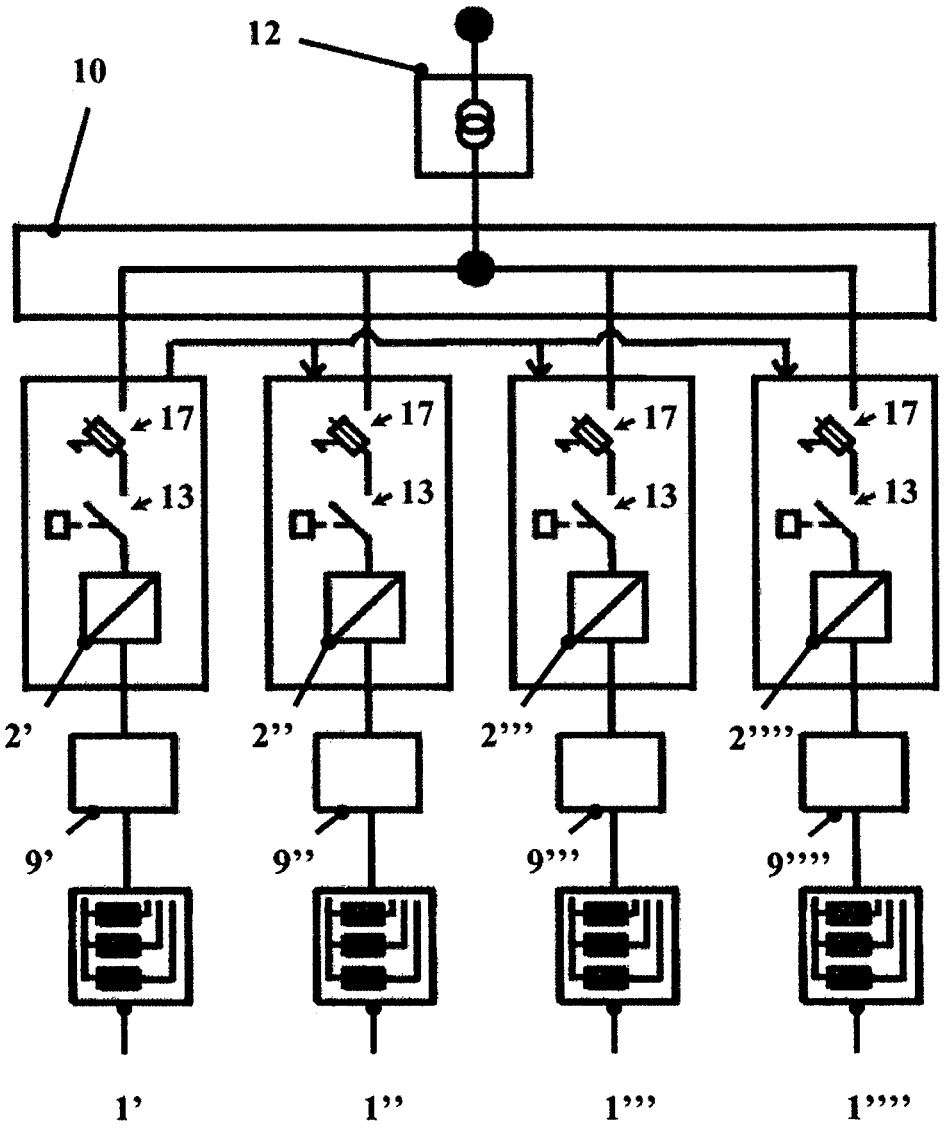
FIG. 8 represents a connection single line diagram in the case of a particular application of the present invention.

With particular reference (FIG. 3, FIG. 4, FIG. 7) to the power stage (26) of the IGBT type of the inverter (2), the connection with the linear electromagnetic stirrer device (11*b*) occurs according to a configuration in which multiple connection branches are used. A first output branch of the inverter (2) of a first phase is connected to a first end of a first coil (20') of the linear electromagnetic stirrer device (11*b*). A second output branch of the inverter (2) of a second phase is connected to a first end of a second coil (20") of the linear electromagnetic stirrer device (11*b*). A third output branch of the inverter (2) of a third phase is connected to a first end of a third coil (20") of the linear electromagnetic stirrer device (11*b*). A fourth output branch of the inverter (2) of a fourth phase is connected to the star point of the coils (20', 20", 20'"), that is to say, the fourth branch of the inverter (2) is connected to the second end of the first coil (20') and to the second end of the second coil (20") and to the second end of the third coil (20') of the linear electromagnetic stirrer device (11*b*). This architecture allows to produce a balanced output current also in unbalanced load conditions, as in the case of an electromagnetic stirrer device of the linear type (11*b*). The architecture of the three-phase inverter (2) and the connection diagram in the case (FIG. 3, FIG. 4, FIG. 7) of a linear electromagnetic stirrer device (11*b*) are similar to the architecture of the three-phase inverter (2) and connection diagram in the case (FIG. 2) of a rotary electromagnetic stirrer device (11*a*), but in the case (FIG. 3, FIG. 4, FIG. 7) of a linear electromagnetic stirrer device (11*b*) there is the fourth output branch of the inverter (2) of a fourth phase which is connected either to the positive conductor of the DC link or to the negative one, providing the flexibility to control the neutral potential, and, therefore, produce a balanced voltage on the load consisting of the linear electromagnetic stirrer device (11*b*) which in itself is not a balanced load, thanks to the presence of a fourth IGBT branch that controls the star point. For example when (FIG. 4) an unbalanced load, such as a linear electromagnetic stirrer device (11*b*), is connected to the inverter (2) provided with a fourth output branch of a fourth phase with a 3D SVPWM (space vector pulse width modulation) control algorithm, one obtains (FIG. 5, FIG. 6) a balance which is highlighted by the voltage (FIG. 5) and current (FIG. 6) waveforms on the unbalanced load.

As previously explained (FIG. 7), the control device (5), which is in the control stage (6) inside the inverter (2), can work with a current feedback signal, which is obtained by means (FIG. 7) of a current sensor (27), for example inside the inverter (2) itself. The current feedback signal is compared with a corresponding current reference and the so obtained current error signal is sent to a current regulator which increases or decreases the output voltage of the inverter (2) in such a way as to obtain an output current equal to the corresponding current reference. The control device (5) uses a vector control which is able to provide high precision in the adjustment of the current supplied by the inverter (2) with great stability.

For example, for the purposes of the present invention one can use inverters (2) of the AC/AC type with a load with a maximum power factor of 0.2 or 0.3. For example, one can use inverters with a maximum power factor of 0.2 suitable to work with voltages at the input of the corresponding (FIG. 3) power supply input (3) between 360 and 480 Vac, nominal output current between 400 and 800 Arms, such as 400, 550, 750, 800 Arms, with powers between 60 and 120 kW, such as 60, 70, 80, 100, 120, 140 kW. For example, one can use inverters with a maximum power factor of 0.2 suitable to work with voltages at the input of the corresponding (FIG. 3) power supply input (3) between 540 and 660 Vac, nominal output current between 400 and 800 Arms, such as 400, 550, 750, 800 Arms, with powers between 90 and 210 kW, such as 90, 110, 120, 150, 180, 210 kW. For example, one can use inverters with a maximum power factor of 0.3 suitable to work with voltages at the input of the corresponding (FIG. 3) power supply input (3) between 360 and 480 Vac, nominal output current between 400 and 800 Arms, such as 400, 550, 750, 800 Arms, with powers between 90 and 210 kW, such as 90, 110, 120, 150, 180, 210 kW. For example, one can use inverters with a maximum power factor of 0.3 suitable to work with voltages at the input of the corresponding (FIG. 3) power supply input (3) between 540 and 660 Vac, nominal output current between 400 and 800 Arms, such as 400, 550, 750, 800 Arms, with powers between 130 and 320 kW, such as 130, 160, 180, 220 285, 320 kW.

The inverters (2) may be provided with further auxiliary power supply inputs for the electronics of the power module at 110 or 220 Vac, or for digital inputs at 24 Vdc.

Inverters (2) suitable for the present invention can have an IGBT switching frequency between 0.5 and 1.5 kHz, such as 0.5, 0.75, 1.0, 1.25, 1.5 kHz.

For example (FIG. 9, FIG. 10), consider a casting machine which is configurable according to two operating configurations. In the first operating configuration (FIG. 9) of the casting machine one single product is cast in one single mould (14) under the stirring action of the molten bath by means of four linear stirrers (1', 1", 1'", 1"") comprising a first stirrer device (1'), a second stirrer device (1"), a third stirrer device (1"), a fourth stirrer device (1""). In the second operating configuration (FIG. 10) of the casting machine two products are simultaneously cast in two moulds (14', 14") under the stirring action of the molten bath by means of four linear stirrers (1', 1", 1'", 1""). The two products are cast on parallel casting lines of the same machine under the stirring action of the molten bath by means of two linear stirrers for each casting line; the casting machine is thus provided with a first mould (14') and with a second mould (14"). The first mould (14') is subjected to the action of one pair of the linear stirrers (1', 1") comprising a first stirrer device (1'), a second stirrer device (1"). The second mould (14") is subjected to the action of another pair of linear stirrers (1", 1"") comprising a third stirrer device (1"), a fourth stirrer device (1").

Each of the stirrer devices (1', 1", 1'", 1""), that is to say, the first stirrer device (1'), the second stirrer device (1"), the third stirrer device (1"), the fourth stirrer device (1""), is a stirrer device of the linear type comprising at least two coils (20', 20", 20'"), preferably comprising a first coil (20'), a second coil (20"), a third coil (20'") which are arranged in line one after the other along a longitudinal development axis (23) of the linear electromagnetic stirrer device according to a configuration in which the windings of the coils (20', 20", 20'") are arranged (FIG. 9) on one single plane (24) which is parallel to the longitudinal development axis (23) of the linear electromagnetic stirrer device.

The use of the linear stirrers in pairs or in a configuration with four stirrers is aimed at particular types of casting machines in which the smallest formats of produced metal rod (16) can be cast simultaneously on two parallel lines while the largest formats of produced metal rod (16) are cast in one single central line which is in a central position of the casting machine with respect to the position of the two parallel lines adopted for the small formats. For example, and without limitation for the purposes of the present invention, by the expression "small formats" one means metal rods (16) produced with a circular section and diameters between 400 and 1000 mm. For example, and without limitation for the purposes of the present invention, by the expression "large formats" one means metal rods (16) produced with a circular section and diameters between 1000 and 1600 mm.

Resorting to a simplified single line representation (FIG. 8) the connection of the stirrer devices (1', 1", 1'", 1"") to the supply network occurs by means of one single transformer (12) which supplies a distribution panel (10) supplying each of the inverters (2', 2", 2'", 2"") which supplies a respective stirrer device (1', 1", 1'", 1"") by means of connection boxes (9, 9', 9", 9'", 9""). In particular, the first stirrer device (1') is connected to the first inverter (2'), preferably through a first connection box (9'), the second stirrer device (1") is connected to the second inverter (2"), preferably through a second connection box (9"), the third stirrer device (1'") is connected to the third inverter (2'"), preferably through a third connection box (9'"), the fourth stirrer device (1"") is connected to the fourth inverter (2""), preferably through a fourth connection box (9""). The first inverter (2'), the second inverter (2"), the third inverter (2'") and the fourth inverter (2"") are connected to the distribution panel (10) with the interposition of further devices, such as contactors (13) or disconnectors (17).

Both in the case in which the casting machine is configured to operate in the first operating configuration (FIG. 9) with the casting of one single product in one single mould (14), and in the case in which the casting machine is configured to operate in the second operating configuration (FIG. 10) with the casting of two products in two moulds (14', 14"), pairs of stirrers or stirrer devices (1', 1", 1'", 1"") opposite with respect to the central axis of the mould (14, 14', 14") can be configured in such a way that:

one of the stirrer devices (1', 1", 1'", 1"") of said pair exerts on the molten metal in the mould (14, 14', 14") a force which is oriented in the same direction (FIG. 11) with respect to the other one of the stirrer devices (1', 1", 1'", 1"") of said pair of opposite stirrers or stirrer devices (1', 1", 1'", 1""). For example (FIG. 11) a first stirrer device (1') of said pair exerts on the molten metal a force which is essentially oriented upwards and a second stirrer device (1") of said pair exerts on the molten metal a force which is essentially oriented upwards.

For example a first stirrer device (1') of said pair exerts on the molten metal a force which is essentially oriented downwards and a second stirrer device (1") of said pair exerts on the molten metal a force which is essentially oriented downwards;

one of the stirrer devices (1', 1", 1'", 1"") of said pair exerts on the molten metal in the mould (14, 14', 14") a force which is oriented in the opposite direction (FIG. 12) with respect to the other one of the stirrer devices (1', 1", 1'", 1"") of said pair of opposite stirrers or stirrer devices (1', 1", 1'", 1""). For example (FIG. 12) a first stirrer device (1') of said pair exerts on the molten metal a force which is essentially oriented upwards and a second stirrer device (1") of said pair exerts on the molten metal a force which is essentially oriented downwards. The terms "upwards" and "downwards" refer to the direction of the force of gravity when the mould (14) is installed in an essentially vertical condition. It will be obvious that similar considerations, with adaptations that will be obvious for a person skilled in the art, also apply in the case of a mould arranged inclined with respect to the direction of the force of gravity.

With particular reference to the case in which the casting machine is configured to operate in the first operating configuration (FIG. 9) with the casting of one single product in one single mould (14), it can be provided that four stirrers or stirrer devices (1', 1", 1'", 1"") act as linear stirrers on the molten metal of the mould according to alternate configurations. For example (FIG. 9) in the sequence of four stirrer devices (1', 1", 1'", 1"") arranged around the mould each stirrer device can be configured in such a way as to exert on the molten metal a force which is oriented according to an essentially vertical direction which is an opposite direction with respect to the essentially vertical direction according to which the force exerted by the other stirrer devices adjacent thereto in the sequence of four stirrer devices (1', 1", 1'", 1"") arranged around the mould is oriented. According to this configuration, for example (FIG. 9), the stirrer devices (1', 1", 1'", 1"") may be configured and structured in such a way as to operate according to:

a first operating mode in which the first stirrer device (1') exerts on the molten metal a force which is essentially oriented upwards, the third stirrer device (1'") exerts on the molten metal a force which is essentially oriented downwards, the second stirrer device (1") exerts on the molten metal a force which is essentially oriented upwards, the fourth stirrer device (1"") exerts on the molten metal a force which is essentially oriented downwards;

or a second operating mode in which the first stirrer device (1') exerts on the molten metal a force which is essentially oriented downwards, the third stirrer device (1'") exerts on the molten metal a force which is essentially oriented upwards, the second stirrer device (1") exerts on the molten metal a force which is essentially oriented downwards, the fourth stirrer device (1'''') exerts on the molten metal a force which is essentially oriented upwards;

or a third operating mode in which one alternates time periods in which the stirrer devices (1', 1'', 1''', 1'''') operate in accordance with the first operating mode and time periods in which the stirrer devices (1', 1'', 1''', 1'''') operate in accordance with the second operating mode;

a fourth operating mode in which one alternates time periods in which only a first pair of stirrer devices (1', 1'', 1''', 1'''') reciprocally opposite with respect to the central axis of the mould (14, 14', 14'') operates and time periods in which only a second pair of stirrer devices (1', 1'', 1''', 1'''') reciprocally opposite with respect to the central axis of the mould (14, 14', 14'') operates, which is different from the first pair. For example (FIG. 9) the first stirrer device (1') and the second stirrer device (1'') can operate in a first period while the third stirrer device (1''') and the fourth stirrer device (1'''') are off and the third stirrer device (1''') and the fourth stirrer device (1'''') can operate in a second period, which is subsequent to the first period, while the first stirrer device (1') and the second stirrer device (1'') are off.

The terms "upwards" and "downwards" refer to the direction of the force of gravity when the mould (14) is installed in an essentially vertical condition. It will be obvious that similar considerations, with adaptations that will be obvious for a person skilled in the art, also apply in the case of a mould arranged inclined with respect to the direction of the force of gravity.

It should be noted that the solution according to the invention is characterized by great flexibility of use. In fact, with particular reference to the case in which the casting machine is configured to operate in the first operating configuration (FIG. 9) with the casting of one single product in one single mould (14) which comprises four stirrer devices (1', 1'', 1''', 1'''') each of which is configured as a linear stirrer and provided with at least one pair of coils (20', 20'', 20'''), it may be provided that the four stirrer devices (1', 1'', 1''', 1'''') work all together, each driven by the respective inverter (2', 2'', 2''', 2'''') equipped with the fourth output branch connected to the neutral conductor of the load, that is to say, to the star point of connection of the coils (20', 20'', 20''') according to two possible configurations which are defined in the following as operating configuration with a fourth compensation branch or single-coil operating configuration. In both configurations, one inverter is configured as a master inverter and the other three inverters are configured as slave inverters.

In case of an operating configuration with a fourth compensation branch, the fourth branch of the inverter, connected to the star point of the respective stirrer device (1', 1'', 1''', 1''''), is used to compensate for the unbalanced currents which are created due to the linear typology of the stirrer, as the currents in the three phases are different in the effective value because the geometry of the stirrer creates mutual inductances which are different in the different phases. In this operating configuration all the coils (20', 20'', 20''') of each stirrer device (1', 1'', 1''', 1'''') are supplied similarly to a three-phase rotary stirrer creating a pushing flow, which is oriented upwards or downwards. Preferably in this case the stirrer devices (1', 1'', 1''', 1'''') are used in pairs according to a configuration in which each stirrer forms a pair with the diametrically opposite one and each pair is alternatively activated for a given time interval, in accordance with the previously defined fourth operating mode in which one alternates time periods in which only a first pair of stirrer devices (1', 1'', 1''', 1'''') reciprocally opposite with respect to the central axis of the mould (14, 14', 14'') operates and time periods in which only a second pair of stirrer devices (1', 1'', 1''', 1'''') reciprocally opposite with respect to the central axis of the mould (14, 14', 14'') operates, which is different from the first pair. The motion induced in the molten metal occurs along the casting axis. The stirrers forming a pair can work with the same sequence of phases (FIG. 11) or with an inverted sequence of phases between one stirrer and the other (FIG. 12), in accordance with what has been outlined above.

In case of a single-coil operating configuration, preferably, only one coil (20', 20'', 20''') of each stirrer device (1', 1'', 1''', 1'''') is supplied. For example, one can use only the first coils (1') of the first stirrer device (1'), second stirrer device (1''), third stirrer device (1''') and fourth stirrer device (1''''). In the case in which one only uses the coils which are placed in a closer position with respect to the beginning of the mould (14), that is to say, closer to the zone in which the molten metal is cast, which in the exemplary embodiment (FIG. 9) are the first coils (20'), one obtains an effect similar to that of a rotary stirrer mounted in the highest position of the mould. In the case in which one only uses the coils which are placed in a closer position with respect to the end of the mould (14), that is to say, closer to the exit zone of the metal rod (16) from the mould, which in the exemplary embodiment (FIG. 9) are the third coils (20'''), one obtains an effect similar to that of a rotary stirrer mounted in the lowest position of the mould. In the case in which one only uses the coils which are placed in an intermediate position with respect to the previous ones, which in the exemplary embodiment (FIG. 9) are the second coils (20''), one obtains an effect similar to that of a rotary stirrer mounted in the intermediate position of the mould. Advantageously, however, the use of such three different rotary stirring modes can be varied as desired during the casting process without it being necessary to change the position of the stirrer within the mould, which can occur only with the machine stopped and the mould open. Each inverter drives only one coil by using the fourth branch of the inverter, connected to the star point of the respective stirrer device (1', 1'', 1''', 1''''), for the return current and in each stirrer the current will be phase-shifted by 90° with respect to that of the previous or following stirrer, enabling the clockwise or anti-clockwise rotation of the electromagnetic field. In this mode the movement induced in the molten metal is rotary with an axis parallel to that of casting, as in the application of the rotary stirrers.

In practice, with particular reference to the case in which the casting machine is configured to operate in the first operating configuration (FIG. 9) with the casting of one single product in one single mould (14), with the described configurations it is possible to pass, as desired, and during a same casting process as well, from a stirring condition of the rotary type to a stirring condition of the linear type.

Considering now the case in which the casting machine is configured to operate in the second operating configuration (FIG. 10) with the casting of two products in two moulds (14', 14''), one obtains that a first mould (14') is subjected to the action of one pair of the linear stirrers (1', 1'') comprising a first stirrer device (1'), a second stirrer device (1'') and a second mould (14'') is subjected to the action of another pair of linear stirrers (1''', 1'''') comprising a third stirrer device (1'''), a fourth stirrer device (1''''). In this case the only operating configuration available is the one with a fourth compensation branch. In fact, the single-coil operating configuration, which has been previously described to obtain a stirring effect similar to that of a rotary stirrer, is not applicable because, there being only two stirrers for each mould (14', 14"), the activation of only one coil for each stirrer would not produce any rotary motion in the molten metal. In particular, considering only, for simplicity, the first mould (14') and considering that for the second mould (14") completely similar considerations apply, one can provide:

- a first operating mode (FIG. 11) in which the first stirrer device (1') exerts on the molten metal a force which is essentially oriented upwards, the second stirrer device (1") exerts on the molten metal a force which is essentially oriented upwards;

or

- a second operating mode in which the first stirrer device (1') exerts on the molten metal a force which is essentially oriented downwards, the second stirrer device (1") exerts on the molten metal a force which is essentially oriented downwards;

or

- a third operating mode (FIG. 12) in which the first stirrer device (1') exerts on the molten metal a force which is essentially oriented upwards, the second stirrer device (1") exerts on the molten metal a force which is essentially oriented downwards or vice versa;

or

- a fourth operating mode in which one alternates first time periods in which the stirrer devices (1', 1") operate in accordance with one of a first operating mode, a second operating mode, a third operating mode, and second time periods in which the stirrer devices (1', 1") operate in accordance with an operating mode which is different from that of the first period and is selected from first operating mode, second operating mode, third operating mode.

The terms "upwards" and "downwards" refer to the direction of the force of gravity when the mould (14) is installed in an essentially vertical condition. It will be obvious that similar considerations, with adaptations that will be obvious for a person skilled in the art, also apply in the case of a mould arranged inclined with respect to the direction of the force of gravity.

Figure 12:
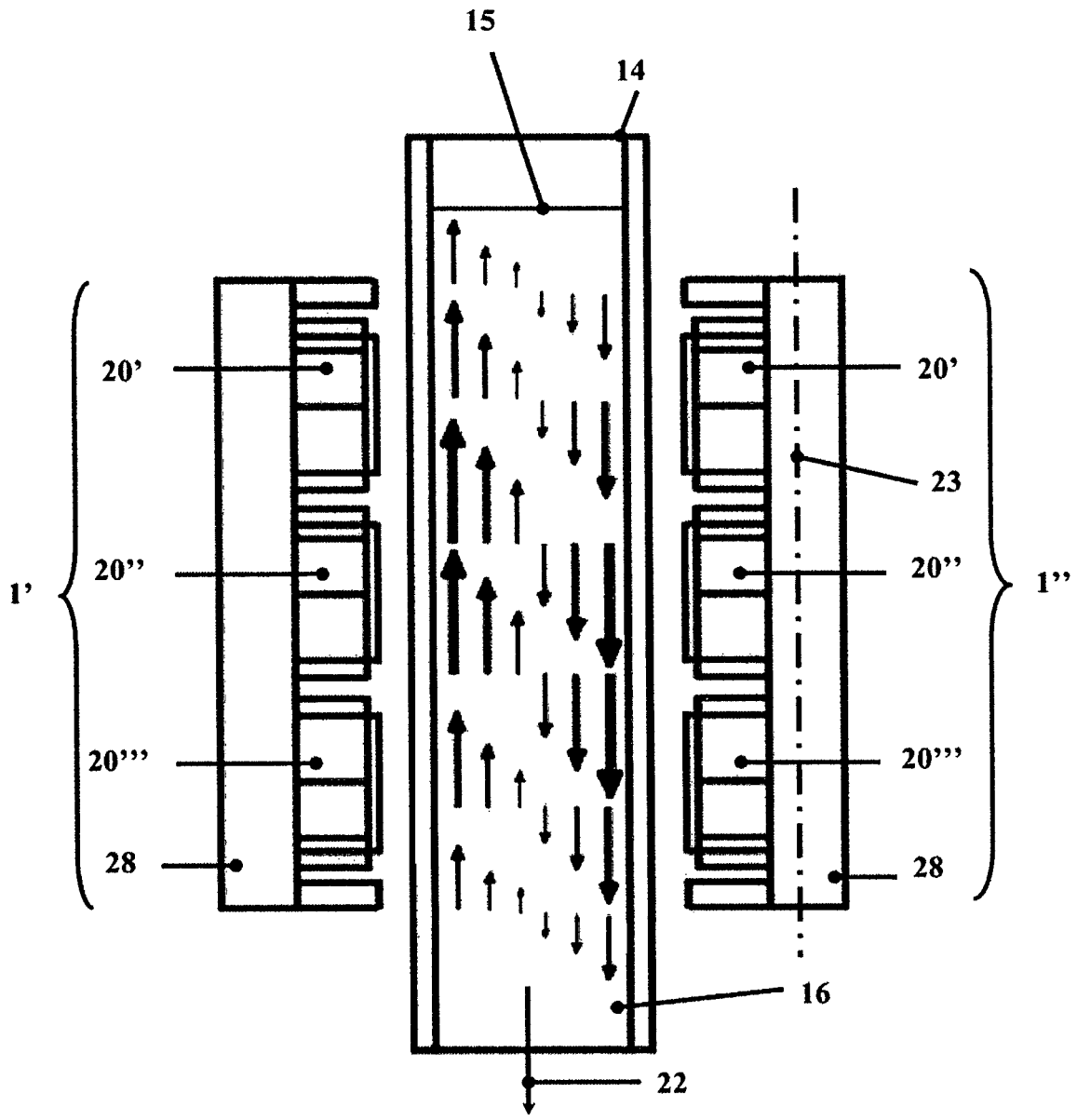
FIG. 12 shows a schematic view of the effect of linear stirrers on one of the casting lines in the case of a second control mode of the linear stirrers.

In the case of a casting machine which is configured to operate in the second operating configuration (FIG. 10) and operating configuration with a fourth compensation branch, all the coils (20', 20", 20''') of each stirrer device (1', 1", 1''', 1'''') are supplied similarly to the three-phase rotary stirrers and each stirrer device (1', 1", 1''', 1'''') is coupled with a corresponding stirrer device (1', 1", 1''', 1'''') which is on the opposite side of the respective mould (14', 14"). The motion induced in the molten metal is along the casting axis. Both stirrer devices of one pair can work in phase (FIG. 11) or out of phase (FIG. 12).

The pair of stirrer devices (1', 1") operating on the first mould (14') is independent from the pair of stirrer devices (1''', 1'''') operating on the second mould (14") and each casting line can be started or stopped independently of the status of the other line.

Figure 9:
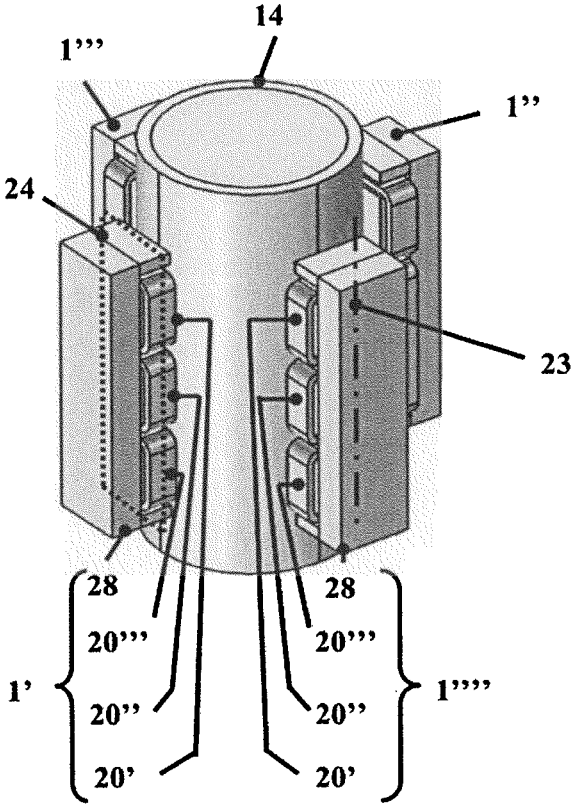
FIG. 9 represents a schematic view of a first operating configuration of a casting machine in which one single product is cast.
Figure 10:
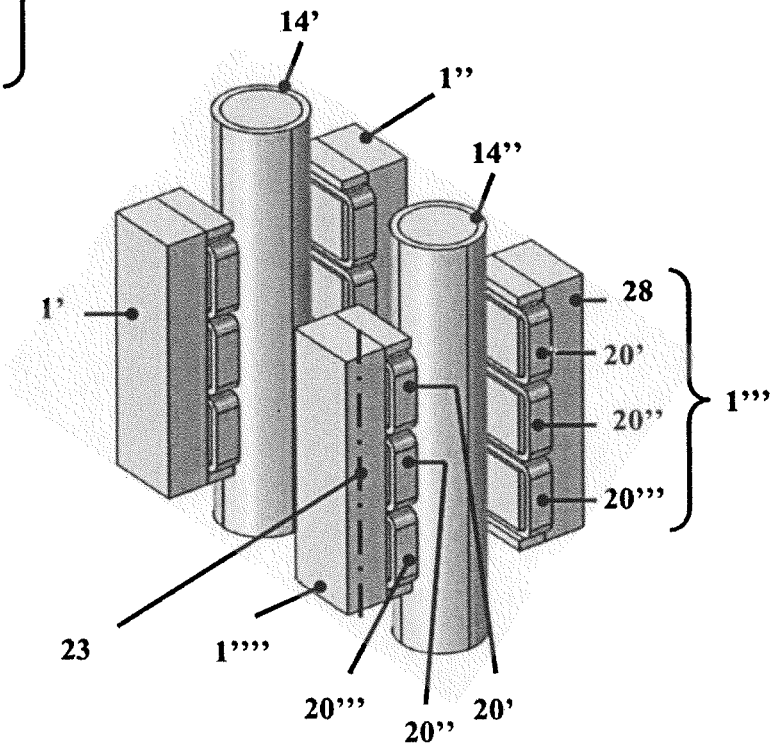
FIG. 10 shows a schematic view of a second operating configuration of the casting machine of FIG. 9 in which two products are simultaneously cast on parallel casting lines of the same machine.
Figure 11:
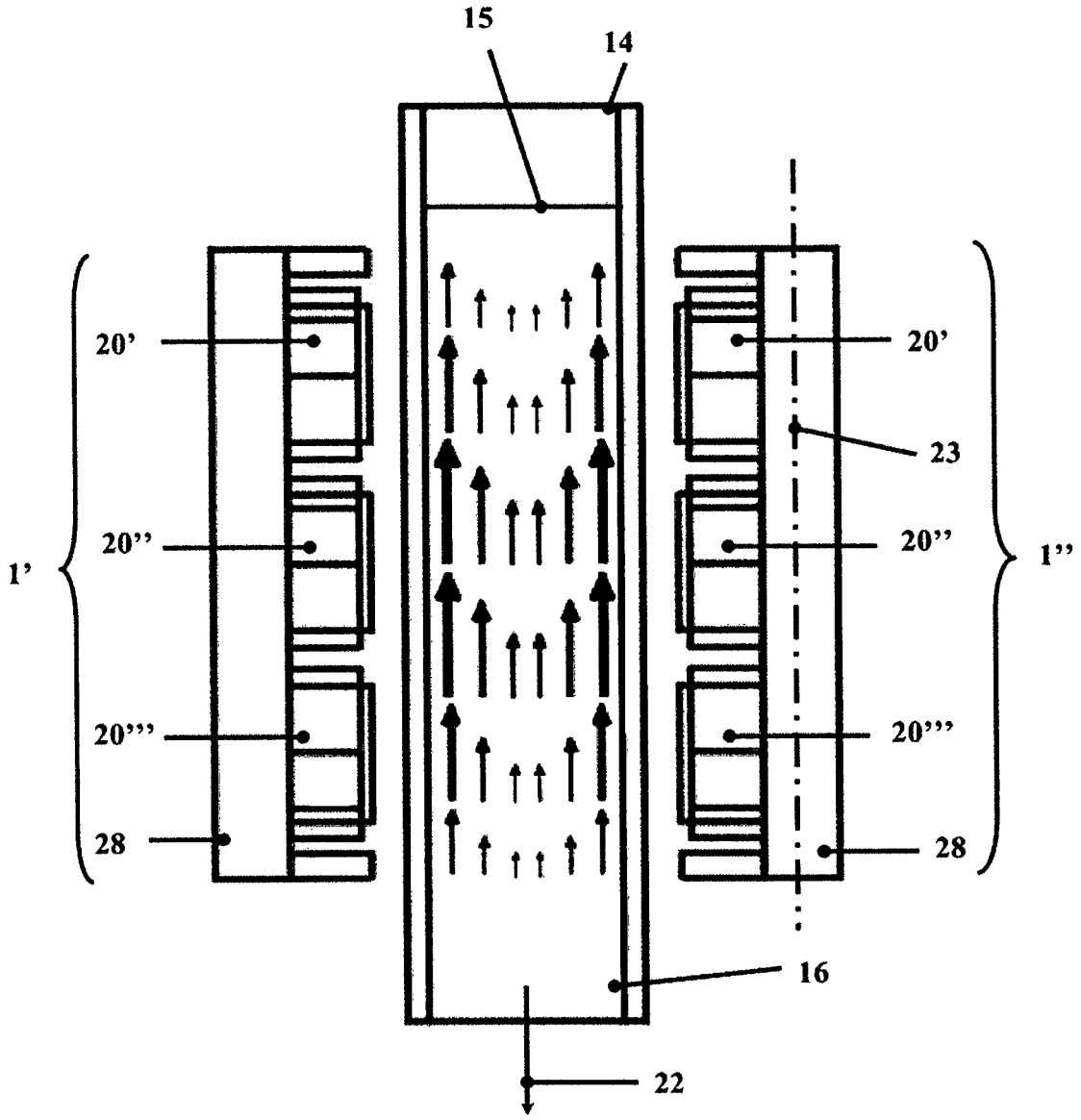
FIG. 11 shows a schematic view of the effect of linear stirrers on one of the casting lines in the case of a first control mode of the linear stirrers.

In the case of a casting machine which can pass from the first operating configuration (FIG. 9) to the second operating configuration (FIG. 10) and vice versa, therefore, one will have:

- a first configuration in which (FIG. 9) the stirrers or stirrer devices (1', 1", 1''', 1'''') operate on one single mould (14) according to what has been previously described with reference to the first operating configuration (FIG. 9). In particular in the operating configuration with a fourth compensation branch the corresponding pairs of stirrers will be (FIG. 9) a first pair (1', 1") and a second pair (1''', 1'''');
- a second configuration in which (FIG. 10) the stirrers or stirrer devices (1', 1", 1''', 1'''') operate on a first mould (14') and a second mould (14") according to what has been previously described with reference to the second operating configuration (FIG. 10). In order to pass from the previous configuration (FIG. 9) to this one (FIG. 10), the stirrers are rotated and moved into the new position. In particular, in the operating configuration with a fourth compensation branch the corresponding pairs of stirrers will be (FIG. 10) a first pair (1', 1") and a second pair (1''', 1'''').

In any casting configuration, first configuration (FIG. 9) with one single mould (14) or second configuration (FIG. 10) with two moulds (14', 14") a master inverter is able to control the other slave inverters independently of one another, coupling them according to what is required by the configuration of the casting machine.

Therefore, by the solution according to the invention one will have different operating modes according to what is summarized in the following tables.

TABLE 1

| Casting lines | Operating | Stirrer 1' Master | Stirrer 1" Slave | Stirrer 1''' Slave | Stirrer 1'''' Slave | Direction of the force exerted by the field | | | |
|---|---|---|---|---|---|---|---|---|---|
| config. | configuration | (20'''/20"/20') | (20'''/20"/20') | (20'''/20"/20') | (20'''/20"/20') | 1' | 1" | 1''' | 1'''' |
| 1 Line (FIG. 9) | 0 single coil | 0°/—/— | 180°/—/— | 90°/—/— | 270°/—/— | ↻ or ↺ | | | |
| | 1 $4^{th}$ compens. | 0°/120°/240° | 0°/120°/240° | —/—/— | —/—/— | ↑ | ↑ | — | — |
| | branch | —/—/— | —/—/— | 0°/120°/240° | 0°/120°/240° | — | — | ↑ | ↑ |
| | 2 $4^{th}$ compens. | 0°/120°/240° | 240°/120°/0° | —/—/— | —/—/— | ↑ | ↓ | — | — |
| | branch | —/—/— | —/—/— | 0°/120°/240° | 240°/120°/0° | — | — | ↑ | ↓ |

In the operating configurations indicated by "0", "1", "2" in table 1 the casting machine operates in the first operating configuration (FIG. 9) in which one single product is cast in one single mould (14) under the stirring action of the molten bath by means of four linear stirrers or stirrer devices (1', 1", 1''', 1'''') which are arranged around the mould (14) at ninety-degree angles with respect to each other and, proceeding clockwise (FIG. 9) in the following order: first stirrer device (1'), third stirrer device (1'''), second stirrer device (1"), fourth stirrer device (1'''').

In the operating configuration indicated by "0" the stirrer devices (1', 1", 1''', 1'''') are controlled according to a single-coil operating configuration in which, preferably but not necessarily, only one coil (20', 20", 20'") of each stirrer device (1', 1", 1'", 1"") is supplied.

Each inverter drives one single coil by using the fourth branch of the inverter, connected to the star point of the respective stirrer device (1', 1", 1'", 1""), for the return current and in each stirrer the current will be phase-shifted by 90° with respect to that of the previous or following stirrer, enabling the clockwise or anti-clockwise rotation of the electromagnetic field. In this mode the movement induced in the molten metal is rotary with an axis parallel to that of casting, as in the application of the rotary stirrers. In practice the linear stirrers are controlled in sequence obtaining an effect, on the molten metal in the mould (14), similar to that of a rotary stirrer.

In the operating configuration indicated by "1" the stirrer devices (1', 1", 1'", 1"") are controlled according to an operating configuration with a fourth compensation branch in which the fourth branch of the inverter, connected to the star point of the respective stirrer device (1', 1", 1'", 1"") is used to compensate for the unbalanced currents which are created due to the linear typology of the stirrer. In this operating configuration all the coils (20', 20", 20'") of each stirrer device (1', 1", 1'", 1"") are supplied similarly to a three-phase rotary stirrer creating a pushing flow, which is oriented upwards or downwards. Preferably in this case the stirrer devices (1', 1", 1'", 1"") are used in pairs according to a configuration in which each stirrer forms a pair with the diametrically opposite one with respect to the mould (14) and each pair is alternatively activated for a given time interval, in compliance with the previously defined fourth operating mode in which one alternates time periods in which only a first pair of stirrer devices (1', 1", 1'", 1"") reciprocally opposite with respect to the central axis of the mould (14, 14', 14") operates and time periods in which only a second pair of stirrer devices (1', 1", 1'", 1"") reciprocally opposite with respect to the central axis of the mould (14, 14', 14") operates, which is different from the first pair. In the specific case of the operating configuration indicated by "1", a first pair of stirrer devices (1', 1", 1'", 1"") consisting of a first stirrer device (1') and second stirrer device (1"), which exert both a force that is oriented upwards, operates in a first time period, while a second pair of stirrer devices (1', 1", 1'", 1"") consisting of a third stirrer device (1'") and fourth stirrer device (1""), which exert both a force that is oriented upwards, operates in a second time period.

In the operating configuration indicated by "2" the stirrer devices (1', 1", 1'", 1"") are controlled according to an operating configuration with a fourth compensation branch in which the fourth branch of the inverter, connected to the star point of the respective stirrer device (1', 1", 1'", 1""), is used to compensate for the unbalanced currents which are created due to the linear typology of the stirrer. In this operating configuration all the coils (20', 20", 20'") of each stirrer device (1', 1", 1'", 1"") are supplied similarly to a three-phase rotary stirrer creating a pushing flow, which is oriented upwards or downwards. Preferably in this case the stirrer devices (1', 1", 1'", 1"") are used in pairs according to a configuration in which each stirrer forms a pair with the diametrically opposite one with respect to the mould (14) and each pair is alternatively activated for a given time interval, in compliance with the previously defined fourth operating mode in which one alternates time periods in which only a first pair of stirrer devices (1', 1", 1'", 1"") reciprocally opposite with respect to the central axis of the mould (14, 14', 14") operates and time periods in which only a second pair of stirrer devices (1', 1", 1'", 1"") reciprocally opposite with respect to the central axis of the mould (14, 14', 14") operates, which is different from the first pair. In the specific case of the operating configuration indicated by "2", a first pair of stirrer devices (1', 1") consisting of a first stirrer device (1') and second stirrer device (1"), in which the first stirrer device (1') exerts a force that is oriented upwards and the second stirrer device (1") exerts a force that is oriented downwards, operates in a first time period, while a second pair of stirrer devices (1'", 1"") consisting of a third stirrer device (1'") and fourth stirrer device (1""), in which the third stirrer device (1'") exerts a force that is oriented upwards and the fourth stirrer device (1"") exerts a force that is oriented downwards, operates in a second time period.

TABLE 2

| Casting lines | Operating | Stirrer 1' Master | Stirrer 1" Slave | Stirrer 1'" Slave | Stirrer 1"" Slave | Direction of the force exerted by the field | | | |
|---|---|---|---|---|---|---|---|---|---|
| config. | configuration | (20'"/20"/20') | (20'"/20"/20') | (20'"/20"/20') | (20'"/20"/20') | 1' | 1" | 1'" | 1"" |
| 2 Lines (FIG. 10) One line is operative | 3 $4^{th}$ compens. branch | 0°/120°/240° | 0°/120°/240° | —/—/— | —/—/— | ↑ | ↑ | — | — |
| One line is inoperative | 4 $4^{th}$ compens. branch | —/—/— | —/—/— | 0°/120°/240° | 0°/120°/240° | — | — | ↑ | ↑ |
| | 5 $4^{th}$ compens. branch | 0°/120°/240° | 240°/120°/0° | —/—/— | —/—/— | ↑ | ↓ | — | — |
| | 6 $4^{th}$ compens. branch | —/—/— | —/—/— | 0°/120°/240° | 240°/120°/0° | — | — | ↑ | ↓ |

In the operating configurations indicated by "3", "4", "5", "6" in table 2 the casting machine operates in the second operating configuration (FIG. 10) in which the machine is configured and structured to cast simultaneously two products in two moulds (14', 14") under the stirring action of the molten bath by means of four linear stirrers or stirrer devices (1', 1", 1'", 1""). In particular, a first stirrer device (1') and a second stirrer device (1") are arranged facing each other on opposite sides of the first mould (14') and wherein a third stirrer device (1'") and a fourth stirrer device (1"") are arranged facing each other on opposite sides of the second mould (14").

In the operating configuration indicated by "3" only the first mould (14') related to a first casting line is operative, while the second mould (14") related to a second casting line is inoperative in the sense that no molten metal is cast in it. The first stirrer device (1') and the second stirrer device (1") exert both a force that is oriented upwards.

In the operating configuration indicated by "4" only the second mould (14") related to a second casting line is operative, while the first mould (14') related to a first casting line is inoperative in the sense that no molten metal is cast in it. The third stirrer device (1''') and the fourth stirrer device (1'''') exert both a force that is oriented upwards.

In the operating configuration indicated by "5" only the first mould (14') related to a first casting line is operative while the second mould (14'') related to a second casting line is inoperative in the sense that no molten metal is cast in it. The first stirrer device (1') exerts a force that is oriented upwards and the second stirrer device (1'') exerts a force that is oriented downwards.

In the operating configuration indicated by "6" only the second mould (14'') related to a second casting line is operative while the first mould (14') related to a first casting line is inoperative in the sense that no molten metal is cast in it. The third stirrer device (1''') exerts a force that is oriented upwards and the fourth stirrer device (1'''') exerts a force that is oriented downwards.

In the operating configuration indicated by "8" both the first mould (14') related to a first casting line and the second mould (14'') related to a second casting line are operative. On the first mould (14'), the first stirrer device (1') exerts a force that is oriented upwards and the second stirrer device (1'') exerts a force that is oriented downwards. On the second mould (14''), the third stirrer device (1''') exerts a force that is oriented upwards and the fourth stirrer device (1'''') exerts a force that is oriented downwards.

In the operating configuration indicated by "9" both the first mould (14') related to a first casting line and the second mould (14'') related to a second casting line are operative. On the first mould (14'), the first stirrer device (1') exerts a force that is oriented upwards and the second stirrer device (1'') exerts a force that is oriented downwards. On the second mould (14''), the third stirrer device (1''') and the fourth stirrer device (1'''') exert both a force that is oriented upwards.

TABLE 3

| Casting lines | Operating | Stirrer 1' Master | Stirrer 1'' Slave | Stirrer 1''' Slave | Stirrer 1'''' Slave | Direction of the force exerted by the field | | | |
|---|---|---|---|---|---|---|---|---|---|
| config. | configuration | (20'''/20''/20') | (20'''/20''/20') | (20'''/20''/20') | (20'''/20''/20') | 1' | 1'' | 1''' | 1'''' |
| 2 Lines (FIG. 10) Both lines are operative | 7 $4^{th}$ compens. branch | 0°/120°/240° | 0°/120°/240° | 0°/120°/240° | 0°/120°/240° | ↑ | ↑ | ↑ | ↑ |
| | 8 $4^{th}$ compens. branch | 0°/120°/240° | 240°/120°/0° | 0°/120°/240° | 240°/120°/0° | ↑ | ↓ | ↑ | ↓ |
| | 9 $4^{th}$ compens. branch | 0°/120°/240° | 240°/120°/0° | 0°/120°/240° | 0°/120°/240° | ↑ | ↓ | ↑ | ↑ |
| | 10 $4^{th}$ compens. branch | 0°/120°/240° | 0°/120°/240° | 0°/120°/240° | 240°/120°/0° | ↑ | ↑ | ↑ | ↓ |

In the operating configurations indicated by "7", "8", "9", "10" in table 3 the casting machine operates in the second operating configuration (FIG. 10) in which the machine is configured and structured to cast simultaneously two products in two moulds (14', 14'') under the stirring action of the molten bath by means of four linear stirrers or stirrer devices (1', 1'', 1''', 1''''). In particular, a first stirrer device (1') and a second stirrer device (1'') are arranged facing each other on opposite sides of the first mould (14') and wherein a third stirrer device (1''') and a fourth stirrer device (1'''') are arranged facing each other on opposite sides of the second mould (14'').

In the operating configuration indicated by "7" both the first mould (14') related to a first casting line and the second mould (14'') related to a second casting line are operative. On the first mould (14'), the first stirrer device (1') and the second stirrer device (1'') exert both a force that is oriented upwards. On the second mould (14''), the third stirrer device (1''') and the fourth stirrer device (1'''') exert both a force that is oriented upwards.

In the operating configuration indicated by "10" both the first mould (14') related to a first casting line and the second mould (14'') related to a second casting line are operative. On the first mould (14'), the first stirrer device (1') and the second stirrer device (1'') exert both a force that is oriented upwards. On the second mould (14''), the third stirrer device (1''') exerts a force that is oriented upwards and the fourth stirrer device (1'''') exerts a force that is oriented downwards.

By the solution according to the invention the operating modes according to what is summarized in the following tables are also possible.

TABLE 4

| Casting lines | Operating | Stirrer 1' Master | Stirrer 1'' Slave | Stirrer 1''' Slave | Stirrer 1'''' Slave | Direction of the force exerted by the field | | | |
|---|---|---|---|---|---|---|---|---|---|
| config. | configuration | (20'''/20''/20') | (20'''/20''/20') | (20'''/20''/20') | (20'''/20''/20') | 1' | 1'' | 1''' | 1'''' |
| 1 Line (FIG. 9) | 11 $4^{th}$ compens. | 240°/120°/0° | 240°/120°/0° | —/—/— | —/—/— | ↓ | ↓ | — | — |
| | branch | —/—/— | —/—/— | 240°/120°/0° | 240°/120°/0° | — | — | ↓ | ↓ |
| | 12 $4^{th}$ compens. | 0°/120°/240° | 0°/120°/240° | —/—/— | —/—/— | ↑ | ↑ | — | — |
| | branch | —/—/— | —/—/— | 240°/120°/0° | 240°/120°/0° | — | — | ↓ | ↓ |
| | 13 $4^{th}$ compens. | 240°/120°/0° | 240°/120°/0° | —/—/— | —/—/— | ↓ | ↓ | — | — |
| | branch | —/—/— | —/—/— | 0°/120°/240° | 0°/120°/240° | — | — | ↑ | ↑ |

In the operating configurations indicated by "11", "12", "13", in table 4 the casting machine operates in the first operating configuration (FIG. 9) in which one single product is cast in one single mould (14) under the stirring action of the molten bath by means of four linear stirrers or stirrer devices (1', 1'', 1''', 1'''') which are arranged around the mould (14) at ninety-degree angles with respect to each other and, proceeding clockwise (FIG. 9) in the following order: first stirrer device (1'), third stirrer device (1'''), second stirrer device (1''), fourth stirrer device (1''''). The stirrer devices (1', 1'', 1''', 1'''') are controlled according to an operating configuration with a fourth compensation branch in which the fourth branch of the inverter, connected to the star point of the respective stirrer device (1', 1'', 1''', 1''''), is used to compensate for the unbalanced currents which are created due to the linear typology of the stirrer.

In this operating configuration all the coils (20', 20'', 20''') of each stirrer device (1', 1'', 1''', 1'''') are supplied similarly to a three-phase rotary stirrer creating a pushing flow, which is oriented upwards or downwards. Preferably in this case the stirrer devices (1', 1'', 1''', 1'''') are used in pairs according to a configuration in which each stirrer forms a pair with the diametrically opposite one with respect to the mould (14) and each pair is alternatively activated for a given time interval, in compliance with the previously defined fourth operating mode in which one alternates time periods in which only a first pair of stirrer devices (1', 1'', 1''', 1'''') reciprocally opposite with respect to the central axis of the mould (14, 14', 14'') operates and time periods in which only a second pair of stirrer devices (1', 1'', 1''', 1'''') reciprocally opposite with respect to the central axis of the mould (14, 14', 14'') operates, which is different from the first pair. In the specific case of the operating configuration indicated by "11", a first pair of stirrer devices (1', 1'', 1''', 1'''') consisting of a first stirrer device (1') and second stirrer device (1''), which exert both a force that is oriented downwards, operates in a first time period, while a second pair of stirrer devices (1', 1'', 1''', 1'''') consisting of a third stirrer device (1''') and fourth stirrer device (1''''), which exert both a force that is oriented downwards, operates in a second time period. In the specific case of the operating configuration indicated by "12", a first pair of stirrer devices (1', 1'', 1''', 1'''') consisting of a first stirrer device (1') and second stirrer device (1''), which exert both a force that is oriented upwards, operates in a first time period, while a second pair of stirrer devices (1', 1'', 1''', 1'''') consisting of a third stirrer device (1''') and fourth stirrer device (1''''), which exert both a force that is oriented downwards, operates in a second time period.

In the specific case of the operating configuration indicated by "13", the situation is similar to that described for the operating configuration indicated by "12" with the difference that the first pair of stirrer devices (1', 1'', 1''', 1'''') consisting of a first stirrer device (1') and second stirrer device (1''), which exert both a force that is oriented downwards, operates in the first time period, while the second pair of stirrer devices (1', 1'', 1''', 1'''') consisting of a third stirrer device (1''') and fourth stirrer device (1''''), which exert both a force that is oriented upwards, operates in the second time period.

TABLE 5

| Casting lines | Operating | Stirrer 1' Master | Stirrer 1'' Slave | Stirrer 1''' Slave | Stirrer 1'''' Slave | Direction of the force exerted by the field | | | |
|---|---|---|---|---|---|---|---|---|---|
| config. | configuration | (20'''/20''/20') | (20'''/20''/20') | (20'''/20''/20') | (20'''/20''/20') | 1' | 1'' | 1''' | 1'''' |
| 2 Lines (FIG. 10) One line is operative | 14 $4^{th}$ compens. branch | 240°/120°/0° | 240°/120°/0° | —/—/— | —/—/ | ↓ | ↓ | — | — |
| One line is inoperative | 15 $4^{th}$ compens. branch | —/—/— | —/—/— | 240°/120°/0° | 240°/120°/0° | — | — | ↓ | ↓ |

In the operating configurations indicated by "14", "15" in table 5 the casting machine operates in the second operating configuration (FIG. 10) in which the machine is configured and structured to cast simultaneously two products in two moulds (14', 14'') under the stirring action of the molten bath by means of four linear stirrers or stirrer devices (1', 1'', 1''', 1''''). In particular, a first stirrer device (1') and a second stirrer device (1'') are arranged facing each other on opposite sides of the first mould (14') and wherein a third stirrer device (1''') and a fourth stirrer device (1'''') are arranged facing each other on opposite sides of the second mould (14'').

In the operating configuration indicated by "14" only the first mould (14') related to a first casting line is operative while the second mould (14'') related to a second casting line is inoperative in the sense that no molten metal is cast in it. The first stirrer device (1') and the second stirrer device (1'') exert both a force that is oriented downwards.

In the operating configuration indicated by "15" only the second mould (14'') related to a second casting line is operative while the first mould (14') related to a first casting line is inoperative in the sense that no molten metal is cast in it. The third stirrer device (1''') and the fourth stirrer device (1'''') exert both a force that is oriented downwards.

TABLE 6

| Casting lines | Operating | Stirrer 1' Master | Stirrer 1'' Slave | Stirrer 1''' Slave | Stirrer 1'''' Slave | Direction of the force exerted by the field | | | |
|---|---|---|---|---|---|---|---|---|---|
| Config. | configuration | (2'''/20''/20') | (2'''/20''/20') | (2'''/20''/20') | (2'''/20''/20') | 1' | 1'' | 1''' | 1'''' |
| 2 Lines (FIG. 10) Both lines are operative | 16 $4^{th}$ compens. branch | 240°/120°/0° | 240°/120°/0° | 240°/120°/0° | 240°/120°/0° | ↓ | ↓ | ↓ | ↓ |
| | 17 $4^{th}$ compens. branch | 0°/120°/240° | 0°/120°/240° | 240°/120°/0° | 240°/120°/0° | ↑ | ↑ | ↓ | ↓ |
| | 18 $4^{th}$ compens. branch | 240°/120°/0° | 240°/120°/0° | 0°/120°/240° | 0°/120°/240° | ↓ | ↓ | ↑ | ↑ |

In the operating configurations indicated by "16", "17", "18" in table 6 the casting machine operates in the second operating configuration (FIG. 10) in which the machine is configured and structured to cast simultaneously two products in two moulds (14', 14'') under the stirring action of the molten bath by means of four linear stirrers or stirrer devices (1', 1'', 1''', 1''''). In particular, a first stirrer device (1') and a second stirrer device (1'') are arranged facing each other on opposite sides of the first mould (14') and wherein a third stirrer device (1''') and a fourth stirrer device (1'''') are arranged facing each other on opposite sides of the second mould (14''). In this case both the first mould (14') related to a first casting line and the second mould (14'') related to a second casting line are operative.

In the operating configuration indicated by "16", on the first mould (14'), the first stirrer device (1') and the second stirrer device (1'') exert both a force that is oriented downwards. On the second mould (14''), the third stirrer device (1''') and the fourth stirrer device (1'''') exert both a force that is oriented downwards.

In the operating configuration indicated by "17", on the first mould (14'), the first stirrer device (1') and the second stirrer device (1'') exert both a force that is oriented upwards. On the second mould (14''), the third stirrer device (1''') and the fourth stirrer device (1'''') exert both a force that is oriented downwards.

In the operating configuration indicated by "18", on the first mould (14'), the first stirrer device (1') and the second stirrer device (1'') exert both a force that is oriented downwards. On the second mould (14''), the third stirrer device (1''') and the fourth stirrer device (1'''') exert both a force that is oriented upwards.

It will be evident that table 1, table 2, table 3, table 4, table 5, table 6, have exemplary purposes only and that other combinations are also possible on the basis of what has been previously described.

To conclude, the present invention relates to a control method of at least three electromagnetic stirrer devices (1', 1'', 1''', 1'''') of the linear type acting on metallic material in the molten state contained inside (FIG. 1, FIG. 9, FIG. 10, FIG. 11, FIG. 12) at least one solidification mould (14, 14', 14'') or contained inside a solidified metallic shell of at least one metal rod (16) whose solidification is in process, wherein the metal rod (16) is produced by means of casting in the at least one mould (14, 14', 14''). The stirrer devices (1', 1'', 1''', 1'''') are placed essentially at a same distance with respect to each other according to a radial arrangement around the metallic material in the molten state. Each of the stirrer devices (1', 1'', 1''', 1'''') is provided with at least two induction coils (20', 20'', 20''') made of windings, the coils (20', 20'', 20''') of each of the stirrer devices (1', 1'', 1''', 1'''') being placed (FIG. 9, FIG. 10) in line one after the other along a longitudinal development axis (23) of the electromagnetic stirrer device according to a configuration in which the windings of the coils (20', 20'', 20''') are essentially arranged on one single plane (24) which is parallel to the longitudinal development axis (23) of the respective stirrer device, the coil (20', 20'', 20''') being configured and structured in such a way as to generate an electromagnetic field of application of a stirring force on the metallic material in the molten state. The control method comprises at least one phase of switching between two operating configurations of the electromagnetic stirrer devices (1', 1'', 1''', 1''''). A first operating configuration is such that at least one of the coils (20', 20'', 20''') of a first stirrer device (1') of the stirrer devices (1', 1'', 1''', 1'''') is controlled in a coordinated way with corresponding other coils (20', 20'', 20''') of the other stirrer devices (1'', 1''', 1'''') in such a way that the reciprocally coordinated coils (20', 20'', 20''') generate a rotating electromagnetic field inducing in the metallic material in the molten state a rotational motion on a rotational plane which is essentially orthogonal with respect to a direction of extraction (22) of the metal rod (16) from the mould (14, 14', 14''). A second operating configuration is such that at least two of the coils (20', 20'', 20''') of the stirrer devices (1', 1'', 1''', 1'''') are controlled in a reciprocally coordinated way with respect to each other in such a way that the reciprocally coordinated coils (20', 20'', 20''') generate a linear electromagnetic field inducing in the metallic material in the molten state a linear motion according to a direction parallel to the longitudinal development axis (23) of the respective stirrer device.

The first operating configuration is obtained by means of a series of sub-phases of driving of the reciprocally coordinated coils (20', 20'', 20''') in which each sub-phase of driving is a phase of supply of one of said reciprocally coordinated coils (20', 20'', 20''') by means of a driving current supplied by a respective inverter (2', 2'', 2''', 2'''') between a driving branch of the respective coil (20', 20'', 20''') and a compensation branch of the inverter which is connected to a common star point of the coils (20', 20'', 20''') of the same stirrer device (1', 1'', 1''', 1''''). The combination of the sub-phases of driving of the reciprocally coordinated coils (20', 20'', 20''') is such that the driving current supplied in a first sub-phase to one of the reciprocally coordinated coils (20', 20'', 20''') is phase-shifted with respect to the driving current supplied in a second sub-phase, which is subsequent to the first sub-phase, to another one of the reciprocally coordinated coils (20', 20'', 20''').

In the case (FIG. 9) of four stirrer devices (1', 1'', 1''', 1'''') of the linear type placed according to an opposite pairs configuration, the combination of the sub-phases of driving of the reciprocally coordinated coils (20', 20'', 20''') is such (Table 1, operating configuration "0") that the driving current supplied in the second sub-phase to one of the coils (20', 20'', 20''') of the third stirrer device (1''') is phase-shifted by 90° with respect to the driving current supplied in the first sub-phase to one of the coils (20', 20", 20'") of the first stirrer device (1'), the driving current supplied in a third sub-phase to one of the coils (20', 20", 20'") of the second stirrer device (1") is phase-shifted by 180° with respect to the driving current supplied in the first sub-phase to one of the coils (20', 20", 20'") of the first stirrer device (1'), the driving current supplied in a fourth sub-phase to one of the coils (20', 20", 20'") of the fourth stirrer device (1"") is phase-shifted by 270° with respect to the driving current supplied in the first sub-phase to one of the coils (20', 20", 20'") of the first stirrer device (1'). In the case (FIG. 9) of four stirrer devices (1', 1", 1'", 1"") of the linear type placed according to an opposite pairs configuration, the second operating configuration is obtained by means of a series of sub-steps of driving of the coils (20', 20", 20'") which are configured and structured in such a way that the coils (20', 20", 20'") of at least one of the pairs of stirrer devices are controlled in a reciprocally coordinated way to operate according to an operating mode selected from various modes. In a first operating mode both stirrer devices of the pair exert on the molten metal a force that is essentially oriented upwards (Examples: Table 1—operating configuration "1", Table 2—operating configurations "3" and "4", Table 3—operating configuration "7"). In a second operating mode both stirrer devices of said pair exert on the molten metal a force that is essentially oriented downwards (Examples: Table 4—operating configuration "11", Table 5—operating configurations "14" and "15", Table 6—operating configuration "16"). In a third operating mode one of the stirrer devices of said pair exerts on the molten metal a force that is essentially oriented upwards and the other one of the stirrer devices of said pair exerts on the molten metal a force that is essentially oriented downwards (Examples: Table 1—operating configuration "2", Table 2—operating configurations "5" and "6", Table 3—operating configuration "8"). In a fourth operating mode one alternates first time periods in which the stirrer devices of said pair operate in accordance with one of a first operating mode, second operating mode, third operating mode form, and second time periods in which the stirrer devices of said pair operate in accordance with an operating mode which is different from that of the first time period and is selected from first operating mode, second operating mode, third operating mode.

The terms upwards and downwards refer to the direction of the force of gravity when the mould (14, 14', 14") is installed in an essentially vertical condition.

In the preferred solution of the present invention (FIG. 9, FIG. 10) each of the stirrer devices (1', 1", 1'", 1"") comprises three coils (20', 20", 20'") of which a first coil (20') which is placed upwards, a second coil (20") which is placed in an intermediate position with respect to the first coil (20') and to a third coil (20") which is placed downwards, the terms upwards and downwards referring to the direction of the force of gravity when the mould (14, 14', 14") is installed in an essentially vertical condition. In this case the first operating configuration is obtained by means of a coordinated control of at least the first coils (20') of the stirrer devices (1', 1", 1'", 1""), generating a rotating electromagnetic field inducing in the metallic material in the molten state a rotational motion in correspondence of a higher position with respect to a body (28) of the stirrer devices (1', 1", 1'", 1"");

or at least the second coils (20") of the stirrer devices (1', 1", 1'", 1""), generating a rotating electromagnetic field inducing in the metallic material in the molten state a rotational motion in correspondence of an intermediate position with respect to a body (28) of the stirrer devices (1', 1", 1'", 1"");

or at least the third coils (20'") of the stirrer devices (1', 1", 1'", 1""), generating a rotating electromagnetic field inducing in the metallic material in the molten state a rotational motion in correspondence of a lower position with respect to a body (28) of the stirrer devices (1', 1", 1'", 1"");

or alternate phases of coordinated control in which each of said alternate phases of control is selected from a phase of control of the first coils (20') only with the second coils (20") and the thirds coils (20'") off, a phase of control of the second coils (20") only with the first coils (20') and the third coils (20'") off, a phase of control of the third coils (20'") only with the second coils (20") and the first coils (20') off.

In the solution in which each of the stirrer devices (1', 1", 1'", 1"") comprises three coils (20', 20", 20'"), the second operating configuration is obtained by means of a series of three sub-steps of driving of the coils, of which a first sub-step, a second sub-step subsequent to the previous one and a third sub-step subsequent to the previous one, the second operating configuration being such that at least the coils of one of said pairs of stirrer devices are controlled in a reciprocally coordinated way to operate according to an operating mode selected from various modes. In the first operating mode both stirrer devices of the pair exert on the molten metal a force that is essentially oriented upwards, said first operating mode being obtained by providing in the first sub-step the driving current to the first coil (20') of both stirrer devices of the pair, providing in the second sub-step to the second coil (20") of both stirrer devices of the pair a driving current which is phase-shifted by 120° with respect to the driving current supplied in the first sub-step, providing in the third sub-step to the third coil (20'") of both stirrer devices of the pair a driving current which is phase-shifted by 240° with respect to the driving current supplied in the first sub-step. In the second operating mode both stirrer devices of the pair exert on the molten metal a force that is essentially oriented downwards, said second operating mode being obtained by providing in the third sub-step the driving current to the third coil (20'") of both stirrer devices of the pair, providing in the second sub-step to the second coil (20") of both stirrer devices of the pair a driving current which is phase-shifted by 120° with respect to the driving current supplied in the third sub-step, providing in the first sub-step to the first coil (20') of both stirrer devices of the pair a driving current which is phase-shifted by 240° with respect to the driving current supplied in the third sub-step. In the third operating mode one of the stirrer devices of the pair exerts on the molten metal a force that is essentially oriented upwards and the other one of the stirrer devices of said pair exerts on the molten metal a force that is essentially oriented downwards, said third operating mode being obtained by controlling the stirrer device of the pair which exerts on the molten metal a force that is essentially oriented upwards in such a way that in the first sub-step the driving current is supplied to the first coil (20'), in the second sub-step a driving current is supplied to the second coil (20") which is phase-shifted by 120° with respect to the driving current supplied in the first sub-step, in the third sub-step a driving current is supplied to the third coil (20'") which is phase-shifted by 240° with respect to the driving current supplied in the first sub-step, said third operating mode being further obtained by controlling the stirrer device of the pair which exerts on the molten metal a force that is essentially oriented downwards in such a way that in the third sub-step the driving current is supplied to the third coil (20'''), in the second sub-step a driving current is supplied to the second coil (20'') which is phase-shifted by 120° with respect to the driving current supplied in the third sub-step, in the first sub-step a driving current is supplied to the first coil (20') which is phase-shifted by 240° with respect to the driving current supplied in the third sub-step.

The present invention also relates to a (FIG. 1, FIG. 13, FIG. 14, FIG. 15) casting machine (18) provided with at least one solidification mould (14, 14', 14'') of metallic material in the molten state and provided with electromagnetic stirrer devices (1', 1'', 1''', 1'''') of the linear type acting on metallic material in the molten state contained inside said at least one solidification mould (14, 14', 14'') or contained inside a solidified metallic shell of at least one metal rod (16) whose solidification is in process, wherein the metal rod (16) is produced by means of casting in the at least one mould (14, 14', 14''), wherein the stirrer devices (1', 1'', 1''', 1'''') are placed essentially at a same distance with respect to each other according to a radial arrangement around the metallic material in the molten state, each of the stirrer devices (1', 1'', 1''', 1'''') is provided with at least two induction coils (20', 20'', 20''') made of windings, the coils (20', 20'', 20''') of each of the stirrer devices (1', 1'', 1''', 1'''') being arranged in line one after the other along a longitudinal development axis (23) of the electromagnetic stirrer device according to a configuration in which the windings of the coils (20', 20'', 20''') are essentially arranged (FIG. 9, FIG. 10) on one single plane (24) which is parallel to the longitudinal development axis (23) of the respective stirrer device, the coils (20', 20'', 20''') being configured and structured in such a way as to generate an electromagnetic field of application of a stirring force on the metallic material in the molten state. The casting machine (18) is provided with a control unit (21) which controls at least the stirrer devices (1', 1'', 1''', 1''''), the control unit (21) being configured and structured to control the electromagnetic stirrer devices according to a control method in accordance with what has been previously described.

In one embodiment the casting machine (18) is provided with four stirrer devices (1', 1'', 1''', 1'''') of the linear type, the casting machine (18) being configurable according to two operating configurations. In a first operating configuration the casting machine (18) is configured and structured for the casting of the metal rod (16) which is one single metal rod (16) cast in one single mould (14) of the casting machine (18) under the stirring action of the molten bath by means of four stirrer devices (1', 1'', 1''', 1'''') comprising a first stirrer device (1'), a second stirrer device (1''), a third stirrer device (1'''), a fourth stirrer device (1''''), wherein the stirrer devices are placed according to an opposite pairs configuration, wherein the stirrer devices (1', 1'', 1''', 1'''') are essentially placed at a same distance with respect to each other and according to a radial arrangement along reciprocally orthogonal axes around the metallic material in the molten state, a first pair of stirrer devices (1', 1'') consisting of the first stirrer device (1') which is placed in a reciprocally faced condition with respect to the second stirrer device (1'') along a first one of said orthogonal axes according to an arrangement in which the metallic material in the molten state is placed between the first stirrer device (1') and the second stirrer device (1''), a second pair of stirrer devices (1''', 1'''') consisting of the third stirrer device (1''') which is placed in a reciprocally faced condition with respect to the fourth stirrer device (1'''') along a second one of said orthogonal axes according to an arrangement in which the metallic material in the molten state is placed between the third stirrer device (1''') and the fourth stirrer device (1''''). In a second operating configuration the casting machine is configured and structured for the simultaneous casting of two metal rods (16) in two moulds (14', 14'') under the stirring action of the molten bath by means of four linear stirrers (1', 1'', 1''', 1''''), the casting machine being provided with a first mould (14') and with a second mould (14''), the first mould (14') being subjected to the action of one pair of the linear stirrers (1', 1'') comprising the first stirrer device (1'), the second stirrer device (1''), the second mould (14'') being subjected to the action of another pair of linear stirrers (1''', 1'''') comprising the third stirrer device (1'''), the fourth stirrer device (1'''').

The stirrer devices (1', 1'', 1''', 1'''') can be mounted inside the mould (14, 14', 14'') or can be (FIG. 13, FIG. 14, FIG. 15) external and mobile in accordance with patent WO 2013/174512 in the name of the same applicant, to be considered as incorporated for reference. In this case the casting machine is provided with stirrer devices (1', 1'', 1''', 1'''') which are associated with movement means (7, 8) along a development in length of the metallic material rod (16). The movement means (7, 8) comprise coupling means (8) for the coupling with guiding means (7). The movement means (7, 8) are intended for the movement of the stirrer devices (1', 1'', 1''', 1'''') along the guiding means (7) at least for a portion of the total development in length of the metallic material rod (16) in different operating positions along the metallic material rod (16) which is a partially solidified metallic material rod (16) which moves within the cooling chamber (30). The metallic material rod (16) is not completely solidified and consists of a shell in the solid state which encloses a core in the molten state which is intended to be subjected to the action of the electromagnetic field of application of the stirring force. For example (FIG. 15), the movement system can comprise a motor (25) acting on a traction means (31) of a frame (34) which supports the stirrer. The traction means (31) for example can consist of a cable or an equivalent means, which is made to pass in a series of pulleys (29) and to which a counterweight (35) is fixed in order to reduce the effort of the motor. The connection of the electrical appliances of the electromagnetic stirrer device (1) preferably occurs by means of a connection box (9) placed in a protected position and preferably near the intermediate position with respect to the complete stroke of the electromagnetic stirrer device (1) along the guide (7). The connection can occur by means of one or more flexible electrical cables (32) in such a way as to provide freedom of movement of the electromagnetic stirrer device (1) along the guide (7), optionally by means of the passage in a cable drag chain (not shown). The connection of the hydraulic appliances can occur in a completely similar way by means of one or more hoses for fluids (33) for feeding a cooling fluid of the induction coils (12) to dissipate the heat coming from the rod (16).

Furthermore, the present invention also relates to a production plant of metallic material rods (16) comprising a casting machine (18) provided with at least one solidification mould (14, 14', 14'') of metallic material in the molten state and provided with electromagnetic stirrer devices (1', 1'', 1''', 1'''') of the linear type acting on metallic material in the molten state contained inside said at least one solidification mould (14, 14', 14'') or contained inside a solidified metallic shell of at least one metal rod (16) whose solidification is in process, wherein the metal rod (16) is produced by means of casting in the at least one mould (14, 14', 14").

Furthermore, the present invention also relates to a casting process for the production of metallic material rods (16) comprising a casting phase in which the metallic material is cast within at least one mould (14, 14', 14") of a casting machine (18) for the extraction of the metallic material rod (16) from the at least one mould (14, 14', 14"). The metallic material rod (16) coming out of the at least one mould (14, 14', 14") is partially solidified and moves within a cooling chamber (30) of the casting machine (18), the metallic material rod (16) consisting of a shell in the solid state enclosing a core in the molten state. The casting process provides one or more stirring phases of the material in the molten state constituting the core and the stirring phase of the material in the molten state occurs according to a control method of at least three electromagnetic stirrer devices (1', 1", 1''', 1'''') of the linear type acting on the metallic material in the molten state according to what has been previously described.

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but it includes all the changes, modifications and variations in accordance with the appended claims.

NOMENCLATURE USED

With reference to the identification numbers in the enclosed figures, the following nomenclature has been used:

1. Stirrer device
1'. First stirrer device
1". Second stirrer device
1'''. Third stirrer device
1''''. Fourth stirrer device
2. Inverter
2'. First inverter
2". Second inverter
2'''. Third inverter
2''''. Fourth inverter
3. Power supply input
4. Reference input
5. Control device
6. Control stage
7. Guiding means
8. Coupling means
(7, 8). Movement means
9. Connection box
9'. First connection box
9". Second connection box
9'''. Third connection box
9''''. Fourth connection box
10. Distribution panel
11*a*. Stirrer device of the rotary type
11*b*. Stirrer device of the linear type
12. Transformer
13. Contactor
14. Mould
14' First mould
14" Second mould
15. Meniscus
16. Metal rod
17. Disconnector
18. Casting machine
19. Tundish
20'. First coil
20". Second coil
20'''. Third coil
21. Control unit
22. Direction of extraction
23. Longitudinal development axis
24. Plane
25. Motor
26. Power stage
27. Current sensor
28. Body
29. Pulley
30. Cooling chamber
31. Traction means
32. Electrical cable
33. Hose for fluids
34. Frame
35. Counterweight

The invention claimed is:

1. A method of controlling at least three electromagnetic stirrer devices, the at least three electromagnetic stirrer devices being linear and acting on molten metallic material contained within at least one solidification mold so as to produce a metal rod, the at least three electromagnetic stirrer devices being positioned at equal distances from each other, each of the at least three electromagnetic stirrer devices having at least two induction coils, the at least two induction coils generating an electromagnetic field so as to create a stirring action in the molten metallic material, the method comprising:

switching between a pair of operating configurations of a rotary stirrer and a linear stirrer, a first operating condition of the pair of operating configurations controlling at least one of the at least two induction coils of one of the at least three electromagnetic stirrer devices in coordination with the at least two induction coils of another of the at least three electromagnetic stirrer devices so as to generate a rotating electromagnetic field so as to induce the molten metallic material to rotate in a rotational plane orthogonal to a direction of extraction of the metal rod from the at least one solidification mold, a second operating condition of the pair of operating configurations controlling at least two of the at least two induction coils of the at least three electromagnetic stirrer devices in a reciprocally coordinated manner with respect to each other so as to generate a linear electromagnetic field so as to cause linear motion of the molten metallic material in a direction parallel to a longitudinal axis of the at least three electromagnetic stirrer devices, the first operating condition comprising:

driving a series of sub-phases in the at least two induction coils with a driving current supplied by an inverter between a driving branch of the respective at least two induction coils and a compensation branch of the inverter, the compensation branch being connected to a common star point of the at least two induction coils of the respective at least three electromagnetic stirrer devices, the driving current supplied to a first sub-phase of the series of sub-phases being phase-shifted with respect to the driving current supplied to another of the at least two induction coils in a second sub-phase of the series of sub-phases subsequent to the first sub-phase.

2. The method of claim 1, wherein the at least three electromagnetic stirrer devices comprise four electromagnetic stirrer devices arranged in opposing pairs, a first pair of the four electromagnetic stirrer devices having a first stirrer and a second stirrer in which the first stirrer faces the second stirrer, a second pair of the four electromagnetic stirrer devices having a third stirrer and a fourth stirrer facing each other along another orthogonal axis such that the molten metallic material is between the third stirrer and the fourth stirrer.

3. The method of claim 2, the step of driving comprising:

phase-shifting the driving current in the second sub-phase to one of the at least two induction coils of the third stirrer by 90° with respect to the driving current supplied in the first sub-phase to one of the at least two induction coils of the first stirrer;

phase-shifting the driving current in a third sub-phase to one of the at least two induction coils of the second stirrer by 180° with respect to the driving current supplied to the first sub-phase to one of the at least two induction coils of the first stirrer; and phase-shifting the driving current in a fourth sub-phase to one of the at least two induction coils of the fourth stirrer by 270° with respect to the driving current supplied in the first sub-phase to one of the at least two induction coils of the first stirrer.

4. The method of claim 2, the second operating condition comprising:

exerting an upwardly oriented force on the molten metallic material by the at least three electromagnetic stirrer devices.

5. The method of claim 2, the second operating condition comprising:

exerting a downwardly oriented force on the molten metallic material by the at least three electromagnetic stirrer devices.

6. The method of claim 2, the second operating condition comprising:

exerting an upwardly oriented force on the molten metallic material by one of the at least three electromagnetic stirrer devices; and exerting a downwardly oriented force on the molten metallic material by another of the at least three electromagnetic stirrer devices.

7. The method of claim 6, the second operating condition comprising:

alternating time periods in which the at least three electromagnetic stirrer devices exert the upwardly oriented force and the downwardly oriented force.

8. The method of claim 1, wherein each of the at least three electromagnetic stirrer devices has three induction coils in which a first induction coil is positioned upwardly, a second induction coil is placed in an intermediate position between the first coil and a third coil, the third coil being placed in a downward position.

9. The method of claim 8, the first operating condition comprising:

generating a rotating electromagnetic field by the first induction coil of the at least three electromagnetic stirrer devices.

10. The method of claim 8, the first operating condition comprising:

generating a rotating electromagnetic field by the second induction coil of the at least three electromagnetic stirrer devices.

11. The method of claim 8, the first operating condition comprising:

generating a rotating electromagnetic field by the third induction coil of the at least three electromagnetic stirrer devices.

12. The method of claim 8, the second operating condition comprising:

driving current to the first induction coil to both electromagnetic stirrer devices of a first pair so as to exert an upwardly oriented force to the molten metallic material;

phase-shifting the driving current to the second induction coil of the first pair of the at least three electromagnetic stirrer device by 120° from step of driving current to the first induction coil; and phase-shifting the driving current to the third induction coil of the first pair of the at least three electromagnetic the stirrer device by 240° with respect to the step of driving current to the first induction coil.

13. The method of claim 8, the second operating condition comprising:

exerting a downwardly oriented force on the molten metallic material by a first of electromagnetic stirrer devices, the step of exerting comprising:

driving current to the third induction coil of both of the first pair of the at least three electromagnetic stirrer devices;

phase-shifting the driving current to the second induction coil of both of the first pair of the at least three electromagnetic stirrer devices by 120° with respect to the driving current of the third induction coil; and phase-shifting the driving current the first induction coil of the first pair of the at least three electromagnetic stirrer devices by 240° with respect to the driving current to the third induction coil.

14. The method of claim 8, the second operating condition comprising:

exerting an upwardly oriented force on the molten metallic material by one electromagnetic stirrer devices of a first pair; and exerting a downwardly oriented force on the molten metallic material by another electromagnetic stirrer device of the first pair.

* * * * *